US005399475A

United States Patent [19]

Hasebe et al.

[11] Patent Number: 5,399,475

[45] Date of Patent: * Mar. 21, 1995

[54] SILVER HALIDE PHOTOGRAPHIC MATERIALS AND METHOD PRODUCING THEREOF

[75] Inventors: Kazunori Hasebe; Osami Tanabe; Masahiro Asami; Naoto Ohshima; Keisuke Shiba; Toshihiro Nishikawa, all of Kanagawa, Japan

[73] Assignee: Fuji Photo Film Co., Ltd., Kanagawa, Japan

[ * ] Notice: The portion of the term of this patent subsequent to Sep. 12, 2006 has been disclaimed.

[21] Appl. No.: 989,879

[22] Filed: Dec. 11, 1992

Related U.S. Application Data

[63] Continuation of Ser. No. 729,871, Jul. 11, 1991, abandoned, which is a continuation of Ser. No. 593,353, Oct. 19, 1990, abandoned, which is a continuation of Ser. No. 137,891, Dec. 19, 1987, abandoned.

[30] Foreign Application Priority Data

| | | | |
|---|---|---|---|
| Dec. 26, 1986 | [JP] | Japan | 61-311131 |
| Apr. 8, 1987 | [JP] | Japan | 62-86164 |
| Apr. 8, 1987 | [JP] | Japan | 62-86165 |

[51] Int. Cl.[6] ..... G03C 1/005

[52] U.S. Cl. ..... 430/567; 430/505; 430/569; 430/570; 430/572; 430/574; 430/576; 430/577

[58] Field of Search ..... 430/567, 569, 570, 572, 430/574, 576, 577, 505

[56] References Cited

U.S. PATENT DOCUMENTS

| | | | |
|---|---|---|---|
| 4,183,756 | 1/1980 | Locker | 430/569 |
| 4,564,591 | 1/1986 | Tanaka et al. | 430/567 |
| 4,735,894 | 4/1988 | Ogawa | 430/567 |
| 4,865,962 | 9/1989 | Hasebe et al. | 430/569 |

FOREIGN PATENT DOCUMENTS

| | | |
|---|---|---|
| 0154920 | 9/1985 | European Pat. Off. . |
| 0193397 | 9/1986 | European Pat. Off. . |
| 2079012 | 11/1971 | France . |
| 2445541 | 7/1989 | France . |
| 2132372 | 7/1984 | United Kingdom . |

OTHER PUBLICATIONS

*Patent Abstracts of Japan,* vol. 10, No. 308 (p-508) (JP-A-61 122 641) European Search Report.

*Primary Examiner*—Thorl Chea

*Attorney, Agent, or Firm*—Sughrue, Mion, Zinn, Macpeak & Seas

[57] ABSTRACT

A silver halide photographic material having at least one light-sensitive silver halide emulsion layer coated on a support, wherein the silver halide emulsion layer contains silver chlorobromide grains comprising silver chlorobromide containing 90 mol % or more of silver chloride, having at least one region in which the silver bromide content is high at the vicinity of the corner of the grains, and with not more than 15 mol % of average silver bromide content at the surface of the grains. A method producing the silver halide photographic materials is also disclosed.

16 Claims, No Drawings

SILVER HALIDE PHOTOGRAPHIC MATERIALS AND METHOD PRODUCING THEREOF

This is a continuation of application Ser. No. 07/729,871, filed Jul. 11, 1991, now abandoned, which is a continuation of application Ser. No. 07/593,353, filed Oct. 2, 1990, now abandoned, which is a continuation of application Ser. No. 07/137,891, filed Dec. 28, 1987, now abandoned.

FIELD OF THE INVENTION

This invention relates to novel silver halide photographic materials and to a method for producing such. Moreover, the invention relates to high-speed and stable silver halide photographic materials and capable of being quickly processed, and more particularly to high-speed and stable color photographic materials using silver chlorobromide emulsion and giving high utilization efficiency of silver halide.

BACKGROUND OF THE INVENTION

With the increasing growth of color photographic light-sensitive materials, color processing of color photographic materials is more and more simplified and quickened. On the other hand, high quality color images and uniformity of finished image quality have been required. It is known that a silver iodobromide emulsion containing from 4 to 20 mol % silver iodide is generally used for photographing color photographic materials and a silver chlorobromide emulsion is generally used for color photographic papers for printing. It is also known that a silver chlorobromide is reluctant to give images having high quality at high speed as compared to a silver iodobromide emulsion.

Silver chlorides or silver chlorobromide of, in particular, cubic grains having a (100) crystal plane are very useful for rapid simple processing. However, they have the disadvantages that the sensitivity thereof is low, chemical sensitization and spectral sensitization are not easily achieved, the sensitivity obtained is unsuitable, and the silver halide grains have a tendency to produce fog.

Various methods for solving these problems have been proposed. For example, a method of adding water-soluable bromide ions or iodide ions to the silver halide emulsion after adding sensitizing dye(s) thereto is described in Japanese Patent Application (OPI) No. 51627/73 (The term "OPI" as used herein means an "unexamined published application".), Japanese Patent Publication No. 46932/74, etc.; a method of simultaneously adding bromide ions and silver ions to silver halide grains having a high content of silver chloride to form a silver bromide region of more than 60 mol % on the surface of the grains or of similarly forming a layer of 10 mol % to 50 mol % silver bromide on the surface of the grains is described in Japanese Patent Application (OPI) Nos. 108533/83, 222845/85, etc.; and a method of adding bromide ions or simultaneously adding bromide ions and silver ions to silver halide grains having a high content of silver chloride to form, thus, multiphase structure grains such as double layer grains or junction structure grains is described in Japanese Patent Publication Nos. 36978/75, 240772/83, U.S. Pat. No. 4,471,050, West German Patent Application (OLS) No. 3,229,999, etc.

However, all of the aforesaid methods have been found to have various defects in terms of sensitivity and have stability thereof, in particular, a reduction in sensitivity by the addition of color couplers to the silver halide grains, and on the tightness of gradation at shadow portions. Also, it is known that these silver halide emulsions are unstable and thus the production thereof is difficult. This matter is described, for example, in Zuckerman *Journal of Photographic Science,* 24, 142(1976), etc.

SUMMARY OF THE INVENTION

An object of this invention is to provide a color photographic light-sensitive material having high speed and providing in a stable manner processed products having improved uniformity using silver chloride or silver chlorobromide emulsion useful for rapid and simple processing and a method of producing such.

Another object of this invention is to provide a color photographic light-sensitive material providing good gradation of shadowed portions and having high utilization efficiency of silver halide, which can reduce the coating amount of silver, and a method of producing such.

As the result of various investigations, it has now been discovered that the above-described objects can be effectively attained by the present invention as set forth hereinbelow.

That is, the invention is a silver halide photographic material having at least one light-sensitive silver halide emulsion layer coated on a support, wherein said silver halide emulsion layer contains silver chlorobromide grains comprising silver chlorobromide containing 90 mol % or more of silver chloride, having at least one region in which the silver bromide content is high at the vicinity of at least one of the corners of the grains, and with not more than 15 mol % of average silver bromide content at the surface of the grains.

DETAILED DESCRIPTION OF THE INVENTION

The term "the vicinity of the corners" as used in this invention means the area is within the area of a regular square having the side length of about $\frac{1}{3}$, preferably about 1/5, of the diameter of a circle having the same area as the projected area of a normal crystal silver chlorobromide grain such as a cubic grain and the like with the corner (an intersecting point of sides of normal crystal grains such as a cubic grain or the like) as one corner of the square.

Silver chlorobromide grains are present in an amount of 70 mol % or more based on total silver halide grains in the same silver halide emulsion layer.

As a conventional method for preferentially causing halogen conversion from the corners of silver halide host grains or the vicinity of the corners, the forms and photographic properties of silver halide grains in performing halogen displacement by immersing a coated material of a silver bromide emulsion in an aqueous potassium iodide solution and in performing halogen displacement by immersing a coated material of a silver chloride emulsion in an aqueous potassium bromide solution are reported by Klein et al, *Photographishe Korrespondenz,* 102, 59(1966). They found that by the immersion of a coated material of an octahedral grain silver bromide emulsion in an aqueous potassium iodide solution, silver iodide was jointed to the corner portions and the edge portions of the silver bromide grains in projected form as reported therein but the displacement was random displacement having, in particular, no site selectivity in using a cubic grain silver bromide or silver chloride emulsion.

Furthermore, it is reported by Shiozawa in *Bulletin of Society of Photographic Science and Technology of Japan,* 22, 14(1972) that by immersing a coated layer of a cubic grain silver chloride emulsion in a solution of 0.1N potassium bromide saturated with silver bromide for 64 minutes, silver bromide is joined to the corner portions and edge portions of the cubic silver chloride grains.

However, since it is impossible to produce a large quantity of photographic light-sensitive materials by these methods, they are unsuitable for practical photographic light-sensitive materials.

The preferred method for preparing silver halide emulsions in this invention is explained below in detail.

(1) The host silver halide crystals which are used for preparing the Corner Development Grain ("CDG") emulsion of this invention are cubic or tetradecahedral crystal grains (which may have roundish corners and higher order planes) substantially having a (100) plane, the halogen composition thereof is silver chlorobromide, or silver chloride containing 90 mol % of silver chloride and containing no silver iodide or less than 2 mol % silver iodide, and particularly preferably silver halide crystals containing at least 95 mol %, or more preferably at least 99 mol % silver chloride or pure silver chloride crystals. The mean grain size of the host silver halide grains is preferably from 0.2 μm to 2 μm and the distribution state thereof is preferably monodisperse.

The monodisperse silver halide emulsion for use in this invention is a silver halide emulsion having a grain size distribution of less than 0.25 in the coefficient of variation ($S/\bar{r}$) on the grain sizes of the silver halide grains, wherein $\bar{r}$ is a mean grain size and S is a standard deviation of grain sizes.

That is, if the grain size of each silver halide grain is $r_i$ and the number of the grains is $n_i$, the mean grain size $\bar{r}$ is defined as follows;

$$\bar{r} = \frac{\Sigma n_i \cdot r_i}{\Sigma n_i}$$

and the coefficient of variation S is defined as follows;

$$S = \sqrt{\frac{\Sigma(\bar{r} - r_i)^2 \cdot n_i}{\Sigma n_i}}\ .$$

Each grain size in this invention is the diameter of a circle having an area corresponding to the projected area of the silver halide grain as viewed by a well-known method in this field (usually, electron microphotography) as described in T. H. James et al "*The Theory of the photographic Process*", 3rd edition, pages 36–43, published by McMillan Co., 1966. Accordingly, when silver halide grains have other forms than that of a sphere (e.g., cube, octahedron, tetradecahedron, tabular form, potato form, etc.), the mean grain size $\bar{r}$ and the standard deviation S can be obtained as described above.

The coefficient of variation of the grain sizes of silver halide grains is 0.25 or less, preferably 0.20 or less, more preferably 0.15 or less, and most preferably 0.10 or less.

2) Then, bromide ion or fine grains having a high content of silver bromide are supplied to the host silver halide grains described above to precipitate a new silver halide phase which contains higher content of silver bromide at the surface of host silver halide grains. The process proceeds by an exchange reaction between the bromide ions and halogen ions at the surface of the host silver halide grains where bromide ions are supplied, the so-called "halogen conversion", and proceeds by "a recrystallization reaction" between the fine grains of high silver bromide content and host silver halide grains to produce crystals having a more stabilized composition where fine grains or high silver bromide content are supplied, which is considered to be different from the typical "halogen conversion". In the recrystallization reaction, the reaction is promoted by an increased entropy, which is a different reaction than Ostwald ripening. This is disclosed, for example, in H. C. Yutzy Journal of American *Chemical Society*, Vol. 59, page 916 (1937); etc:

It is astonishing matter that a new phase which is rich in silver bromide content is formed at the vicinity of the corner in both reactions which are quite different reactions.

3) CR compounds can be used to attain more effectively the objects of the present invention, i.e., to attain an extraordinarily high sensitivity by concentration of the latent image or development nucleus.

The CR compound is generally a material which function to delay or completely obstruct the initiation of the halogen conversion as compared to crystal planes having no such compound adsorbed thereto by selectively adsorbing onto specific crystal planes and in particular a material which is mainly (selectively) adsorbed on the (100) planes and of the recrystalization of silver halide grains, and functions to restrain the initiation of the conversion on the (100) planes and the recrystalization.

Suitable CR compounds which can be used in this invention, are cyanine dyes, merocyanine dyes, mercaptoazoles (specific examples of which are the compounds shown formulae (XXI), (XXII) or (XXIII) as described hereinafter in detail), and nucleic acid decomposition products (e.g., intermediate decomposition products of deoxyribonucleic acids or ribonucleic acids, adenine, quanine, uracil, cytocil, thymine, etc.).

In particular, compounds shown by following formulae (I), (II) or (III) described below are preferred in this invention.

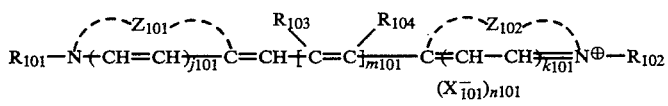

(I)

In the above formula, $Z_{101}$ and $Z_{102}$ each represents an atomic group necessary for forming a heterocyclic nucleus.

Example of suitable heterocyclic nuclei include, 5- or 6-membered cyclic nuclei containing a nitrogen atom and an other atom such as a sulfur atom, an oxygen atom, a selenium atom, or a tellurium atom as the hetero atoms (these rings may have a condensed ring bonded thereto or may be substituted) are preferred.

Specific examples of the aforesaid heterocyclic nuclei are thiazole nuclei, benzothiazole nuclei, naphthothiazole nuclei, selenazole nuclei, benzoselenazole nuclei, naphthoselenazole nuclei, oxazole nuclei, benzoxazole nuclei, naphthoxazole nuclei, imidazole nuclei, benzimidazole nuclie, naphthimidazole nuclei, 4- quinoline nuclei, pyrroline nuclei, pyridine nuclei, tetrazole nuclei, indolenine nuclei, benzindolenine nuclei, indole nuclei, tellurazole nuclei, benzotellurazole nuclei, naphthotellurazole nuclei, etc.

In formula (I), $R_{101}$ and $R_{102}$ each represents an alkyl group, an alkenyl group, an alkynyl group, or an aralkyl group. These groups may be unsubstituted or substituted. For example, the alkyl group included unsubstituted alkyl groups and substituted alkyl groups and these groups may be straight chain, branched, or cyclic groups. The carbon atom number of the alkyl group is preferably from 1 to 8.

Specific examples of substituents for the substituted alkyl groups are a halogen atom (e.g., chlorine, bromine, fluorine, etc.), a cyano group, an alkoxy group, a substituted or unsubstituted amino group, a carboxylic acid group, a sulfonic acid group, a hydroxy group, etc., and the alkyl group may have one substituent or a plurality of substituents.

Specific examples of the alkenyl group are a vinylmethyl group, etc.

Specific examples of the aralkyl group are a benzyl group, a phenethyl group, etc.

In formula (I) described above, $m_{101}$ represents an integer of 1, 2 or 3.

When $m_{101}$ is 1, $R_{103}$ represents a hydrogen atom, a lower alkyl group, an aralkyl group, or an aryl group and $R_{104}$ represents a hydrogen atom. Specific examples of the aforesaid aryl group are a substituted or unsubstituted phenyl group.

When $m_{101}$ is 2 or 3, $R_{103}$ represents a hydrogen atom and $R_{104}$ represents a hydrogen atom, a lower alkyl group, or an aralkyl group or further may combine with $R_{102}$ to form a 5-membered or 6-membered ring.

Also, when $m_{101}$ is 2 or 3 and $R_{104}$ is a hydrogen atom, $R_{103}$ may combine with the other $R_{103}$ to form a hydrocarbon ring or a heterocyclic ring. These rings are preferably a 5- or 6-membered ring.

In formula (I), $j_{101}$ and $k_{101}$ represent 0 or 1, $X_{101}$ represents an acid anion, and $n_{101}$ represents 0 or 1.

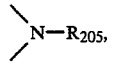

wherein $R_{205}$ has the same significance as $R_{203}$ and $k_{201}$, $R_{201}$, $X^-_{201}$, and $n_{201}$ have the same significance as $j_{101}$, $k_{101}$, $X^-_{101}$, and $n_{101}$, respectively, in formula (I).

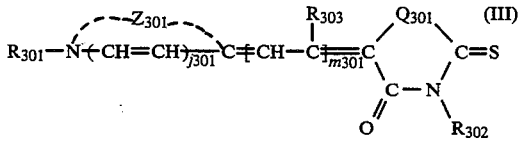

(III)

In formula (III), $Z_{301}$ represents an atomic group necessary for forming a heterocyclic ring.

Examples of suitable heterocyclic rings are the nuclei described above $Z_{101}$ $Z_{102}$ in formula (I) and specific examples of other nuclei are thiazoliadine nuclei, thiazoline nuclei, benzothiazoline nuclei, naphthothiazoline nuclei, selenazolidine nuclei, selenazoline nuclei, benzoselenazoline nuclei, naphthoselenazoline nuclei, benzoxazoline nuclei, naphthoxazoline nuclei, dihydropyridine nuclei, dihydroquinoline nuclei, benzimidazoline nuclei, naphthimidazoline nuclei, etc.

In formula (III) described above, $Q_{301}$ has the same significance as $Q_{201}$ in formula (II), $R_{301}$ has the same significance as $R_{101}$ or $R_{102}$ in formula (I), and $R_{302}$ has the same significance as $R_{203}$ in formula (II).

Also, $R_{303}$ has the same significance as $R_{204}$ in formula (II), and when $m_{301}$ is 2 or 3, $R_{303}$ may combine with other $R_{303}$ to form a hydrocarbon ring or a heterocyclic ring, preferably a 5 to 7-membered ring containing nitrogen atom as a hetero atom.

In formula (III), $j_{301}$ has the same significance as $j_{101}$ in formula (I).

The detailes of the above formulac are described in Japanese Patent Application (OPI) NO. 215272/87, pages 22 to 26.

The CR compounds promote selectivity in the first place to produce the new phase which is richer in silver bromide content than the host grains, and promote the formation and the maintenance of the new phase rich in

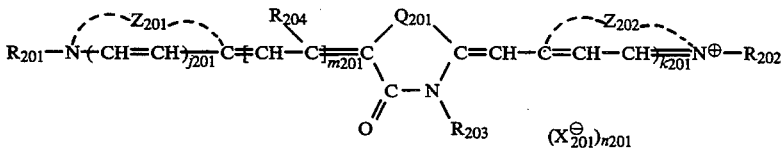

(II)

In formula (II), $Z_{201}$ and $Z_{202}$ have the same significance as $Z_{101}$ or $Z_{102}$. Also, $R_{201}$ and $R_{202}$ have the same significance as $R_{101}$ or $R_{102}$. $R_{203}$ represents an alkyl group, an alkenyl group, an alkynyl group, or an aryl group (e.g., a substituted or unsubstituted phenyl group).

In formula (II), $m_{201}$ represents 0, 1 or 2. $R_{204}$ represents a hydrogen atom, a lower alkyl group, or an aryl group and also when $m_{201}$ is 2, $R_{204}$ and $R_{204}$ may combine with each other to form a hydrocarbon ring or a heterocyclic ring. These rings are preferably a 5- or 6-membered ring.

In formula (II), $Q_{201}$ represents a sulfur atom, an oxygen atom, a selenium atom or silver bromide content, which is grown epitaxially at only the vicinity of the corner of the host grains preventing a reaction that the new phase firstly produced repeats a recrystallization reaction with the surface of the host grains to form a new uniform layer covering the entire surface of the host grains.

Further, it is surprising that an extraordinarily high sensitization which is one of the objects of this invention, is obtained by a preparation of the new phase formed at this limited region.

This high sensitization of this invention tends to provide pressure desensitization, simultaneously. Pressure desensitization is a phenomenon where sensitivity at a pressed region is reduced when pressure is exerted on a photosensitive material before exposure. Pressure desensitization tends to be degraded as silver bromide content in the new phase which is richer in silver bromide content than the host grains increases. Therefore, the silver bromide content in the new phase is preferably 90 mol % or less, and more preferably 60 mol % or less.

A method of supplying bromide ions, the so-called conversion method, tends to form a phase having a high content of silver bromide to cause a degraded pressure desensitization, to cause non-uniform conversion between grains because of a too high reaction speed thereof, and especially to problems of a production on a large commercial scale, since recrystallization reaction proceeds more slowly than the conversion reaction during ripening of the mixture of the host grains and the fine grains having high silver bromide content, the recrystallization reaction has the advantage that reaction uniformity is high and the reaction is easily controllable. In addition, in the recrystallization reaction, silver bromide content in the new phase is widely controllable by varying the silver bromide content of the fine grains having high silver bromide content, grain size, concentration of chloride ions during the recrystallization reaction, etc.

The silver halide grains of this invention contain 90 mol % or more of silver chloride, and have a new phase which is grown epitaxially at the vicinity of the corner of the host grains and have a higher silver bromide content than the host grains, wherein a transition region with a gentle variation of halogen composition may be present between the new phase and the host grains.

Such a grain structure is observed by various analysis methods. Using an electron microscope, a new phase is observed to be joined at the vicinity of the corner of the grains by observing the variation in grain form. By X-ray diffractiometry, the halogen compositions of the host grain and the new phase can be determined. The average halogen composition of the surface is measured by a XPS (X-ray Photoelectron Spectroscopy) method using, for example, ESCA 750 type spectrograph (made by Shimazu Corporation—Du Pont Co., Ltd.). the details of the measurement method are disclosed in Someno and Amoi, *Hyomen Bunseki* (*Surface Analysis*) published by Kodansha (1977).

The proportion of the area of the new phase in the entire surface area of the grain is determined from the halogen compositions of the new phase and the host grain obtained by X-ray diffractiometry and the average halogen composition of the surface of the grain by XPS method.

Further, the position of the new phase which is richer in silver bromide content than the host grain, is identified and the proportion of the area of the new phase at the vicinity of the corner of the grain is measured by the above described electron microscope EDX (Energy Dispersive X-ray Analysis) method, using an EDX spectrometer set on a transmission electron microscope. The details of the measurement as disclosed in Keiji Eukushima *Electron-ray Micro Analysis* published by Nikkan Kogyo (1987).

The preferred grain sizes of the high bromide content silver halide grains of the fine grain silver halide emulsion for use in this invention depend upon the grain sizes of the host grains and the halogen composition thereof but are usually not larger than 0.3 μm, and preferably not larger than 0.1 μm.

In regard to the halogen composition of the fine grain and high bromide content silver halide emulsion for use in this invention, it is necessary that the silver bomide content of the emulsion be higher than that of the host silver halide grains and the silver bromide content of the silver halide emulsion is preferably at least 50 mol %, and more preferably at least 70 ml %.

If desired, the high bromide content fine grain silver halide emulsion for use in this invention can contain silver iodide and also it can contain the ions or a compound of a heavy metal such as iridium, rhodium, platinum, etc.

The fine grain silver halide emulsion is mixed with the host silver halide in the range of from 0.1 to 50 mol % as silver, preferably from 0.2 to 20 mol %, and particularly preferably from 0.2 to 8 mol %. The temperature of mixing can vary but generally is in the range of from 30° C. to 80° C.

The new phase is preferably present partially. In the average halogen proportion of the surface of the grain, silver bromide is preferably not more than 15 mol %, more preferably not more than 10 mol %, and most preferably from about 1 mol % to 10 mol %. An increase of the average silver bromide content of the surface of the grains leads to a decrease of uneven distribution near the vicinity of the corners of the new phase and causes a decrease of sensitivity. It is observed using electron microscope that the new phase obtained by the preferable process of the present invention is epitaxially connected and grown at the corners.

In the CDG emulsion for use in this invention, the development center is concentrated and very high speed is obtained, and further the stability of the emulsion is greatly improved and thus excellent stability can be obtained with less fog and without reducing the rapid developing property. Also, the CDG emulsion has astonishingly high contrast and has the advantages that the occurrence of pressure desentization is less and the formation of fog at the unexposed portions is less.

The CR compounds for use in this invention can be selected from sensitizing dyes. In particular, the CR compounds useful for the (100) plane can be selected from the compounds shown by formulae (I), (II), and (III) described above and since these compounds have a function as sensitizing dyes, the use of these compounds is advantageous for increasing the spectral sensitivity and, in particular, the spectral sensitivity of the emulsion can be stabilized further by the partial recrystalization at the surface. The discovery of such an excellent combination of the CR compounds and the excellent merits thereof is astonishing.

Furthermore, the CR compounds(s) may be combined with other sensitizing dye(s) or super color sensitizer(s) to increase further the sensitivity and stability of the silver halide emulsion.

For example, the CR compounds may be combined with aminostilbene compounds substituted by a nitrogen-containing heterocyclic nucleus group (e.g., the compounds of formula (I), in particular, specifically illustrate compounds (I-1) to (I-17) described in the specification of Japanese Patent Application (OPI) No. 174738/87 filed by the same applicant as herein and the compounds described in U.S. Pat. Nos. 2,933,390 and 3,635,721), aromatic organic acid-formaldehyde condensation products (as described in U.S. Pat. No. 3,743,510), cadmium salts, azaindene compounds, etc. The combinations described in U.S. Pat. Nos. 3,615,613, 3,615,641, 3,617,295, and 3,635,721 are particularly useful.
Then, specific examples of the CR compounds shown by formulae (I), (II), and (III) are illustrated below although the CR compounds in this invention are not limited to these compounds.
CR-1
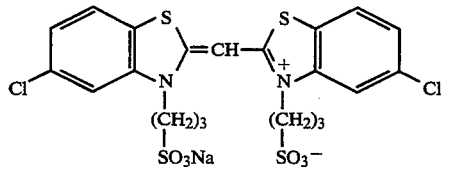
CR-2
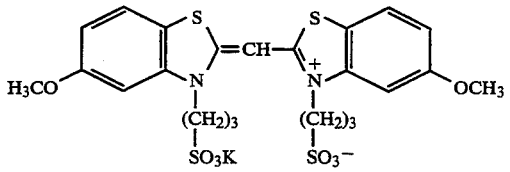
CR-3
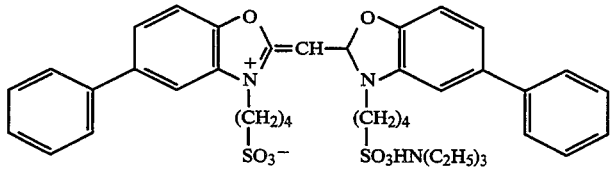
CR-4
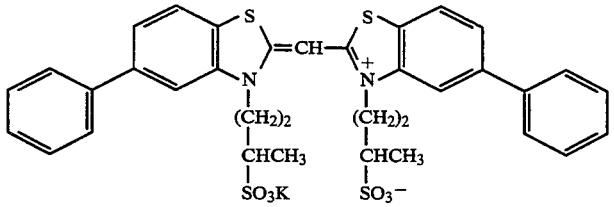
CR-5
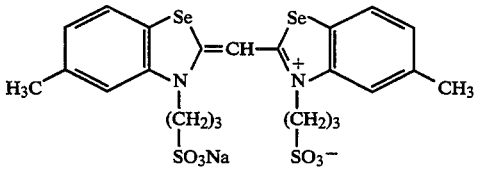
CR-6
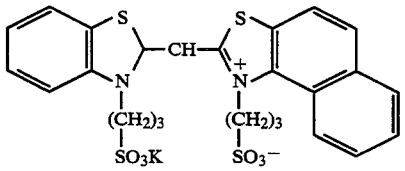
CR-7
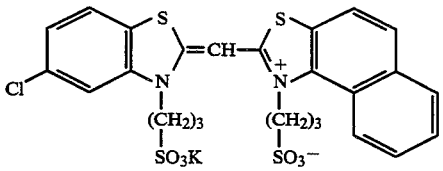
CR-8
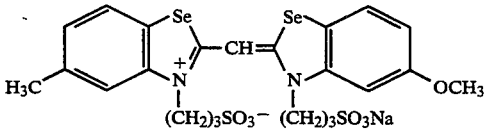

-continued
CR-9
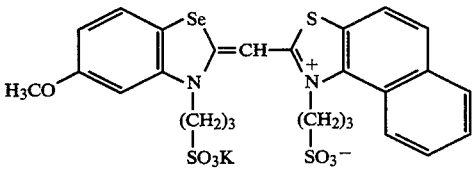
CR-10
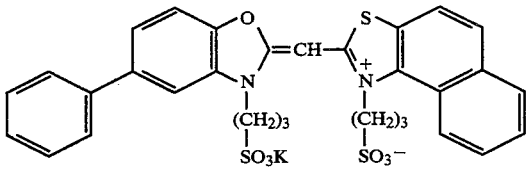
CR-11
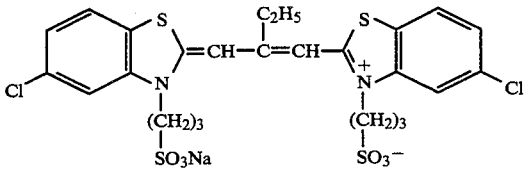
CR-12
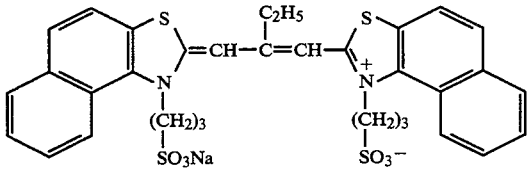
CR-13
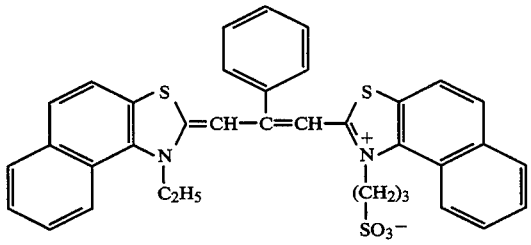
CR-14
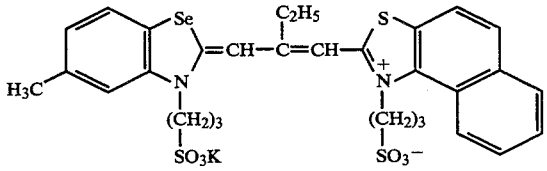
CR-15
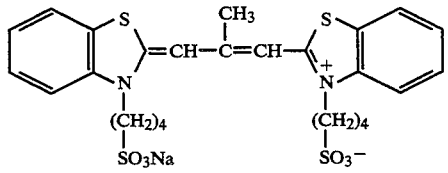
CR-16
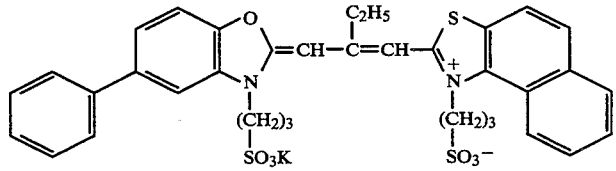

-continued
CR-17
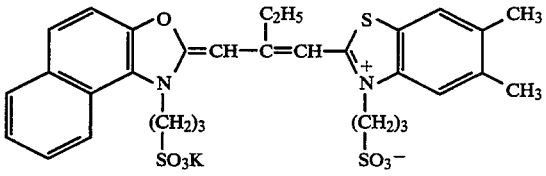
CR-18
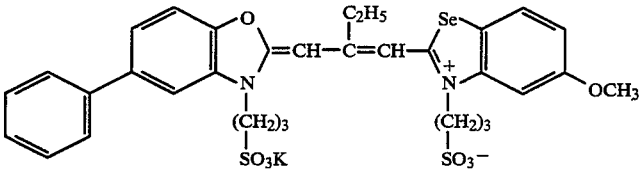
CR-19
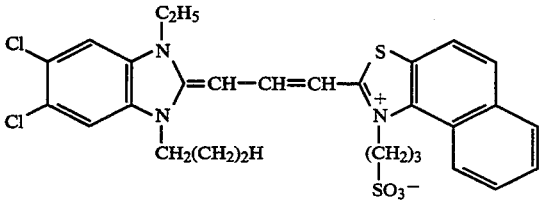
CR-20
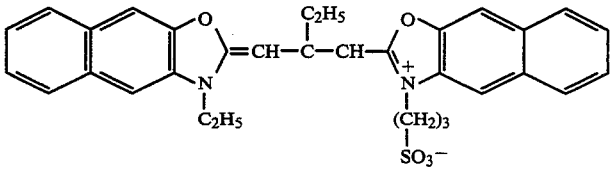
CR-21
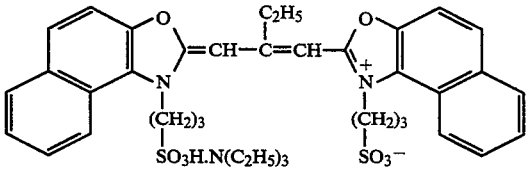
CR-22
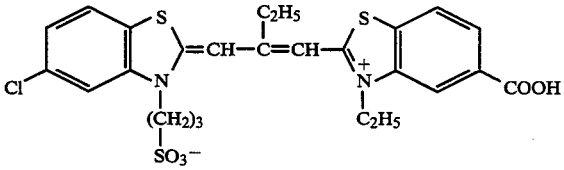
CR-23
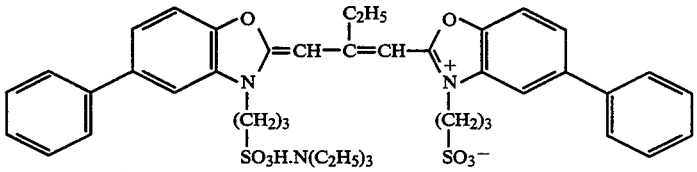
CR-24
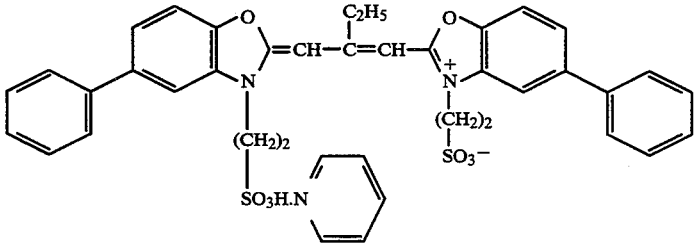

-continued
CR-25
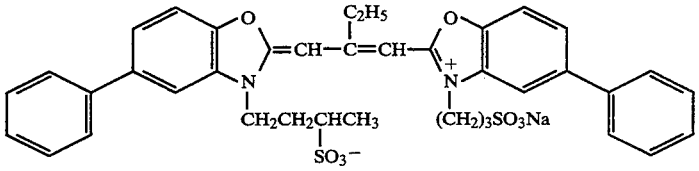
CR-26
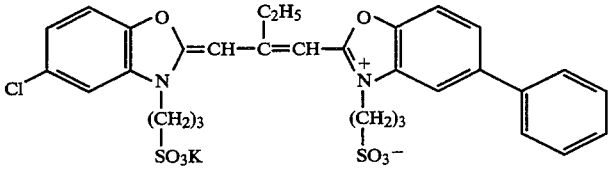
CR-27
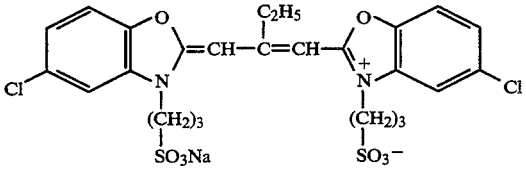
CR-28
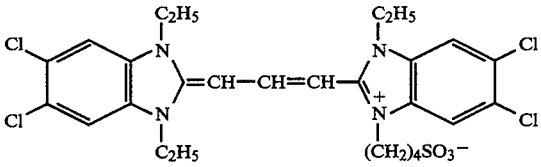
CR-29
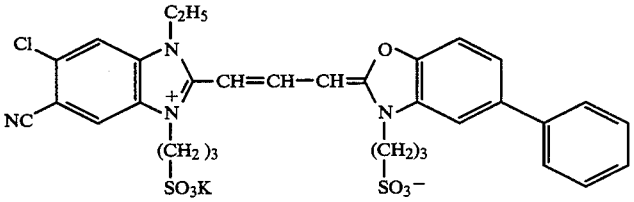
CR-30
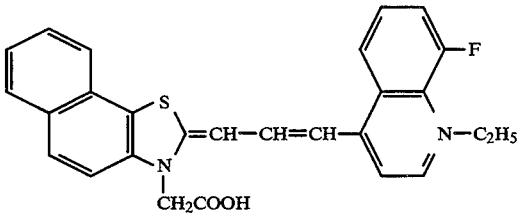
CR-31
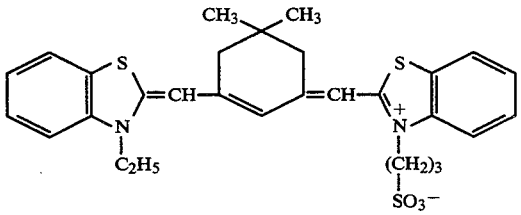
CR-32
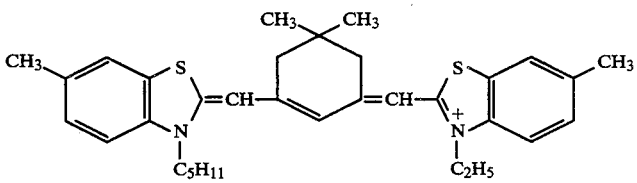
$I^{\ominus}$ -continued
CR-33
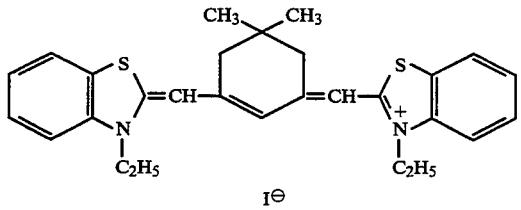
CR-34
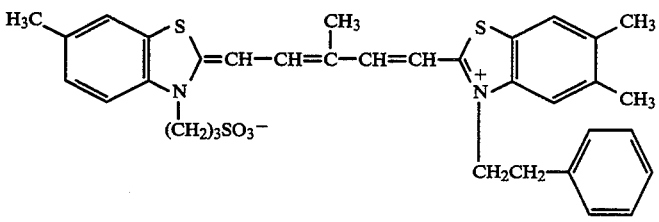
CR-35
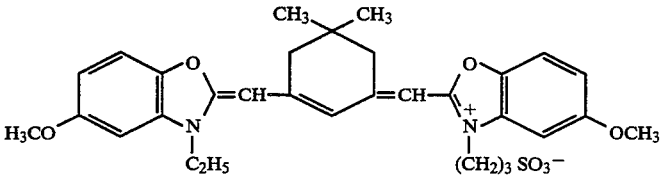
CR-36
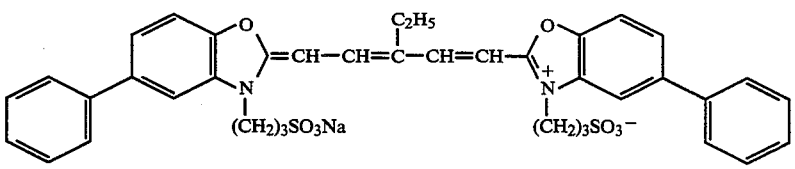
CR-37
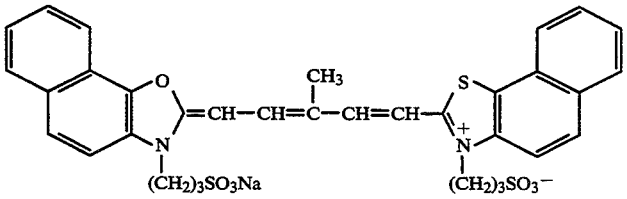
CR-38
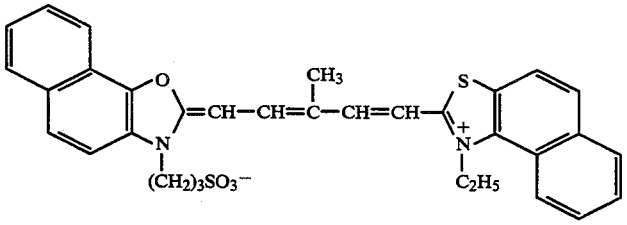
CR-39
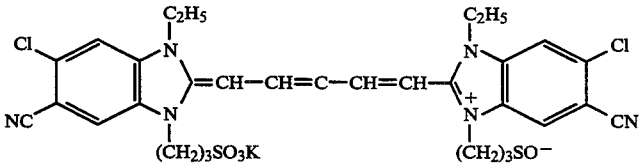
CR-40
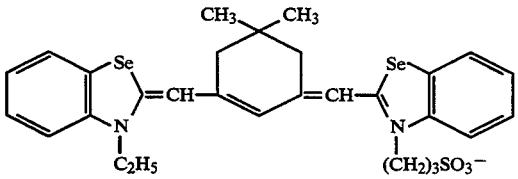

-continued
CR-41
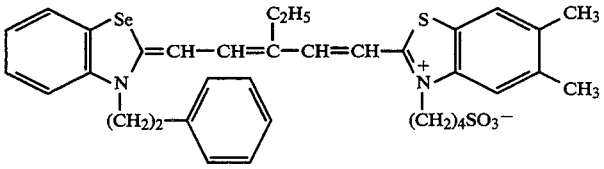
CR-42
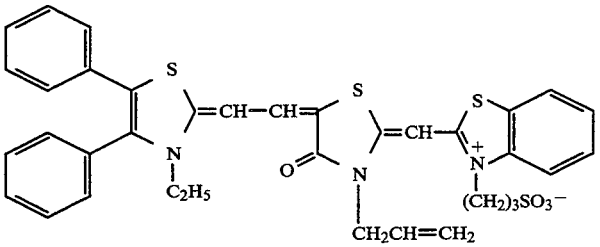
CR-43
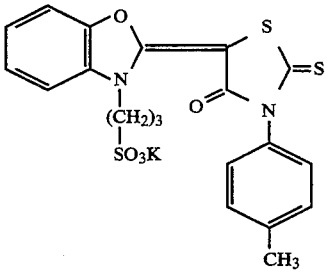
CR-44
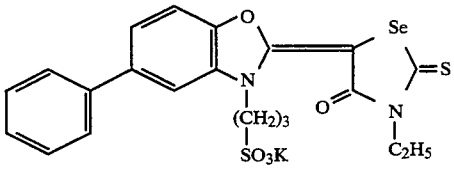
CR-45
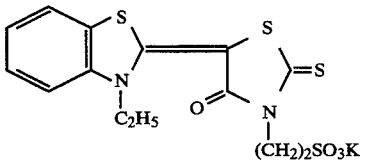
CR-46
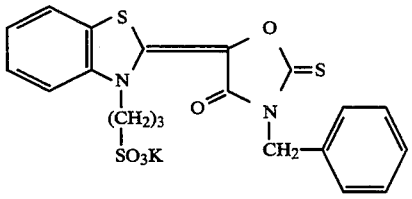
CR-47
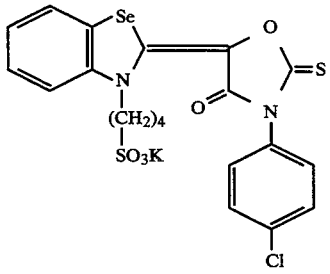

-continued
CR-48
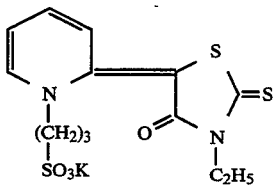
CR-49
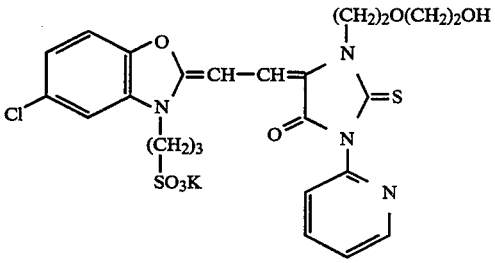
CR-50
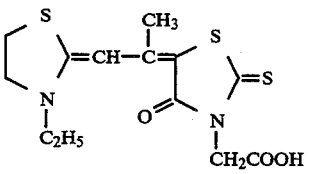
CR-51
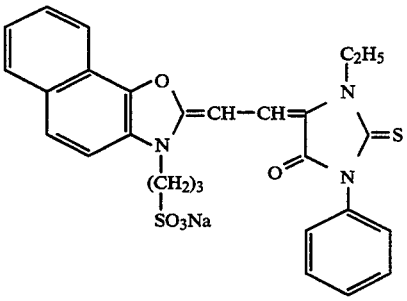
CR-52
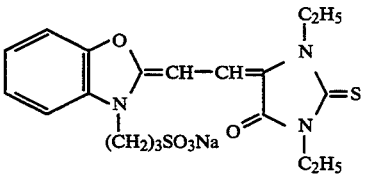
CR-53
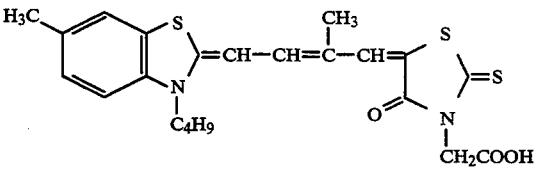
CR-54
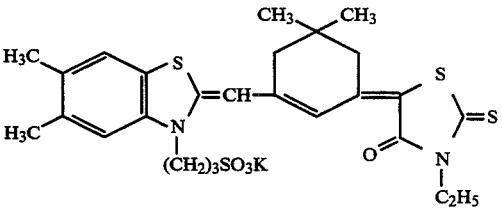

-continued

CR-55

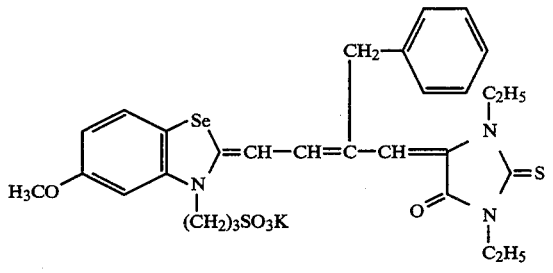

Of the processes to prepare silver halide grains such as a process to add a silver nitrate aqueous solution to an alkali halide aqueous solution, a process of the opposing addition order thereof and a process of the simultaneous addition thereof, preferable process is the simultaneous addition process, more preferably under a control of pAg, to prepare mixed silver halide for obtaining host grains.

The silver halide emulsions for use in this invention are produced by controlling the pH and addition time of silver nitrate and alkali halides.

First, a preferred pH for forming the host silver halide grains in this invention is from 2 to 10. In this case, doping can be applied to the emulsion by using rhodium complex salts, iridium complex salts, lead salts, etc., or a noble metal sensitization (gold sensitization, etc.,) can be applied thereto. As the case may be, sulfur sensitization using a thiosulfate, allylthiocarbamide, cystein, etc., or reduction sensitization using a polyamine, stannous chloride, etc., can be applied to the emulsion.

Then, the aforesaid CR compound is dissolved in a water-miscible organic solvent such as an alcohol (e.g., methanol, etc.), ethyl acetate, etc. or a mixture of such with water and added to the above-described host silver halide emulsion as a solution thereof. Also, the CR compound may be added to the emulsion as a dispersion thereof in an aqueous gelatin solution or an aqueous solution of a surface active agent. The addition amount thereof is preferably from $10^{-6}$ mol % to $10^{-2}$ mol %, and more preferably from $10^{-5}$ mol % to $10^{-3}$ mol % per mol of the host silver halide.

Then, the host silver halide emulsion is mixed with a fine grain high bromide content emulsion as described above and the mixture is ripened while properly controlling the temperature and pAg in the range of from 30° C. to 80° C. and the silver ion concentration range of pAg 5 to 10, respectively.

Thereafter, if necessary, sensitizing dye(s) or super color sensitizer(s) may be added thereto for spectral sensitization.

It is preferred to apply the chemical sensitization as described above to the silver halide emulsion during or after ripening the mixture.

Also, fog inhibitors such as mercaptotriazoles, mercaptotetrazoles, benzotriazoles, etc., can be used the silver halide emulsion for use in this invention.

For rapid processing, a silver chlorobromide emulsion containing a high content of silver chloride is preferably used and for the emulsion, fog inhabitors or stabilizers strongly adsorbing to the silver halide grains, such as mercapto compounds, nitrobenzotriazole compounds, benzotriazole compounds, etc., are used. Also, development accelerators, halation preventing agents, irradiation preventing agents, optical whitening agents, etc., may be used for the silver halide emulsions.

Most preferred stabilizers which are used for the silver halide emulsions in this invention are those represented by following formula (XXI), (XXII) or (XXIII):

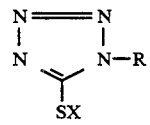

(XXI)

wherein R represents an alkyl group, an alkenyl group or an aryl group and X represents a hydrogen atom, an alkali metal atom, an ammonium group or a precursor thereof.

Examples of alkali metal atoms are a sodium atom, a potassium atom etc., and examples of the ammonium group are a tetramethylammonium group, a triemthylbenzylammonium group, etc. Also, the precursor is a group capable of becoming a hydrogen atom or an alkali metal atom under alkaline conditions and examples thereof are an acetyl group, a cyanoethyl group, a methanesulfonylethyl group, etc.

In the above-described groups shown by R, the alkyl group and alkenyl group include unsubstituted groups and substituted groups as well as alicyclic groups.

Examples of substituents for the substituted alkyl group are a halogen atom, a nitro group, a cyano group, a hydroxy group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, a carboxylic acid group, a sulfonic acid group, or the salts of these acids.

The above-described ureido group, thioureido group, sulfamoyl group, carbamoyl group, and amino group each includes unsubstituted groups, N-alkyl-substituted group, and N-aryl-substituted groups.

Examples of aryl group are a phenyl group and a substituted phenyl group and examples of substituents are an alkyl group and the substituents described above as to the substituent for the alkyl group.

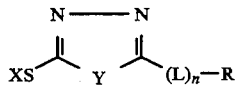

(XXII)

wherein Y represents a sulfur atom or an oxygen atom; L represents a divalent linking group; R represents a hydrogen atom, an alkyl group, an alkenyl group, or an aryl group; X has the same significance as X in formula (XXI) described above; and n represents 0 or 1.

The alkyl group and the alkenyl group shown by R, and X have the same significance as defined above as to R and X of formula (XXI).

Specific examples of the divalent linking group shown by L are

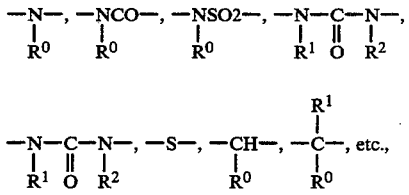

wherein $R^0$, $R^1$, and $R^2$ each represents a hydrogen atom, an alkyl group, or an aralkyl group) or a combination thereof.

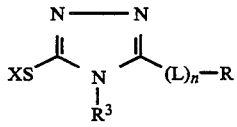

(XXIII)

wherein R and X have the same significance as defined above for formula (XXI); L has the same significance as defined above for formula (XXII); $R^3$ has the same significance as defined R.

The compound shown by formula (XXI), (XXII), or (XXIII) described above can be incorporated in any of the layers of a silver halide color photographic material of this invention and/or in a color developer. The term "any of the layers of silver halide color photographic material" means light-sensitive emulsion layer(s) and/or the light-insensitive hydrophilic colloid layer(s) of the color photographic material.

The addition amount of the compound shown by formula (XXI), (XXII), OR (XXIII) is preferably from $1\times 10^{-5}$ mol to $5\times10^{-2}$ mol, and more preferably from $1\times10^{-4}$ mol to $1\times10^{-2}$ mol per mol of silver halide where such is incorporated in the silver halide color photographic material and is preferably from $1\times10^{-6}$ mol/liter to $1\times10^{-3}$ mol/liter, and more preferably from $5\times10^{-6}$ mol/liter to $5\times10^{-4}$ mol/liter, where such is incorporated in a color developer.

Specific examples of the compounds shown by formulae (XXI), (XXII), and (XXIII) are illustrated below but the invention is not to be construed as being limited to them. In addition, the compounds shown below are described at pages 11 to 30-1 of the specification of Japanese Patent Application No. 114276/86.

XXI-1

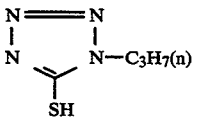

XXI-2

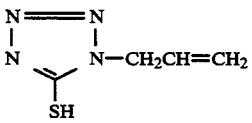

-continued

XXI-3

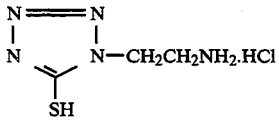

XXI-4

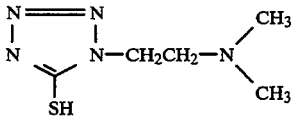

XXI-5

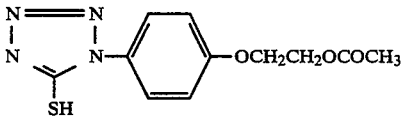

XXI-6

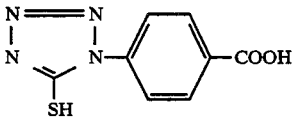

XXI-7

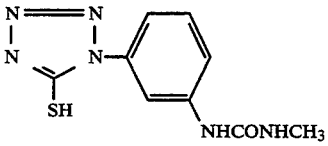

XXI-8

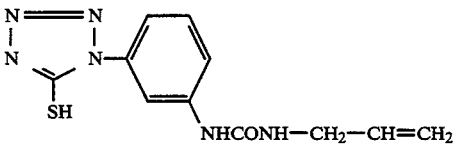

XXII-1

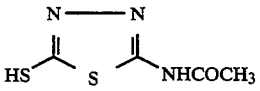

XXII-2

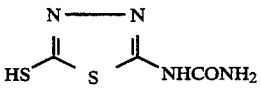

XXII-3

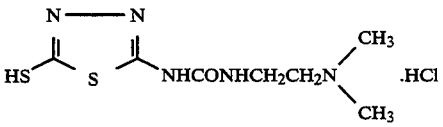

XXII-4

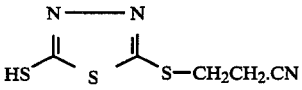

XXII-5

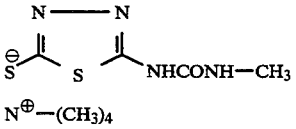

XXIII-1

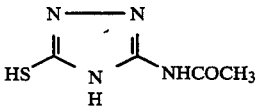

-continued

XXIII-2

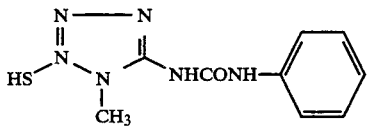

Color couplers which are used in this invention are explained below.

In addition to general requirements such as color hues and high extinction coefficient for the color couplers, since the CDG emulsion shown particularly high development progress, the color couplers must have high activity so that the coupling coloring reaction of the couplers with the oxidation product of a color developing agent such as a p-phenylenediamine derivative does not become the rate determining step. From this view point, use of the couplers represented by following formula (IV), (V), (VI), or (VII) is preferred in this invention.

(IV)

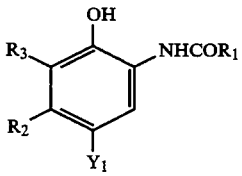

(V)

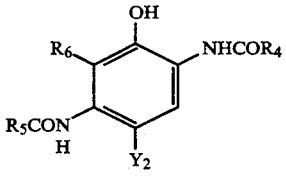

(VI)

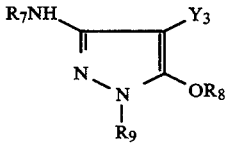

(VII)

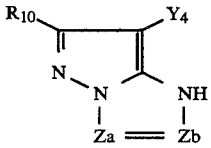

-continued (VIII)

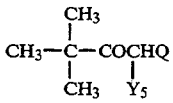

wherein $R_1$, $R_4$, and $R_5$ each represents an aliphatic group, an aromatic group, a heterocyclic group, an aromatic amino group, or a heterocyclic amino group; $R_2$ represents an aliphatic group; $R_3$ and $R_6$ each represents a hydrogen atom, a halogen atom, an aliphatic group, an aliphatic oxy group, or an acylamino group; $R_7$ and $R_9$ each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent; Q represents a substituted or unsubstituted N-phenylcarbamoyl group; Za and Zb each represents methine, substituted methine, or =N—; $Y_1$, $Y_2$, and $Y_4$ each represents a halogen atom or a group capable of releasing on coupling with the oxidation product of a color developing agent (hereinafter, referred to as releasing group); $Y_3$ represents a hydrogen atom or a releasing group; and $Y_5$ represents a releasing group.

In formulae (IV) and (V) described above R2 and R3 or R5 and R6 may combine and form a 5-, 6-, or 7-membered ring.

Furthermore, the compound shown by formula (IV), (V), (VI), (VII), or (VIII) described above may form a dimer or higher polymer at $R_1$, $R_2$, $R_3$, or $Y_1$; $R_4$, $R_5$, $R_6$, or $Y_2$; $R_7$, $R_8$, $R_9$, or $Y_3$; $R_{10}$, $Z_a$, $Z_b$, or $Y_4$; or Q or $Y_5$.

Details of $R_1$, $R_2$, $R_3$, $R_4$, $R_5$, $R_6$, $R_7$, $R_8$, $R_9$, $R_{10}$, $Z_a$, $Z_b$, $Q_1$, $Y_1$, $Y_2$, $Y_3$, and $Y_4$ in formulae (IV), (V), (VI), (VII), and (VIII) are same as those described in regard to formulae (I), (II), (III), (IV), and (V) described in pages 17-3 to 34 of the specification of Japanese Patent Application No. 175233/86.

Specific examples of these couplers are couplers (C-1) to (C-40), couplers (M-1) to (M-42), and couplers (Y-1) to (Y-46) described in pages 36 to 78-3 of the specification of Japanese Patent Application No. 175233/86 and more preferable examples of the couplers are as follows.

C-1

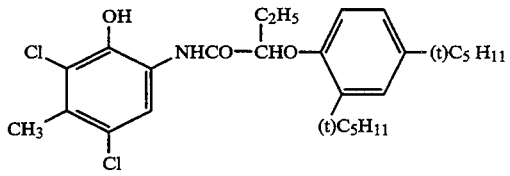

C-2

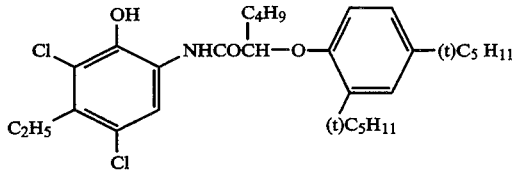

-continued
C-3
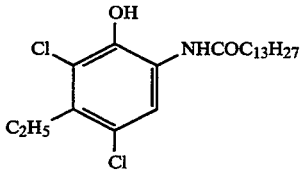
C-4
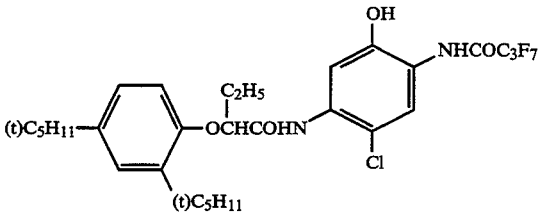
C-5
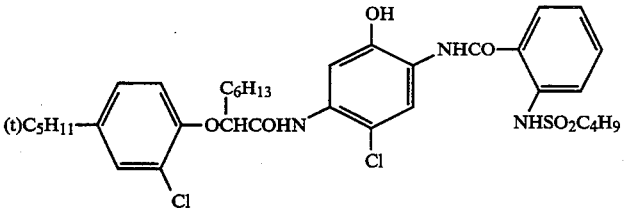
C-6
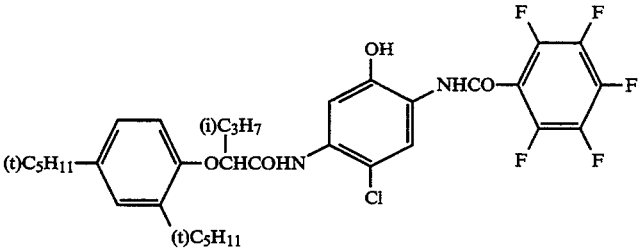
C-7
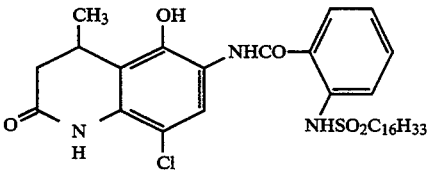
C-8
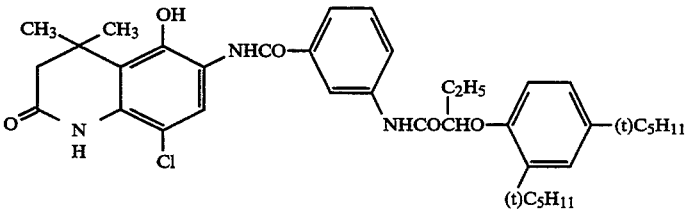
C-9
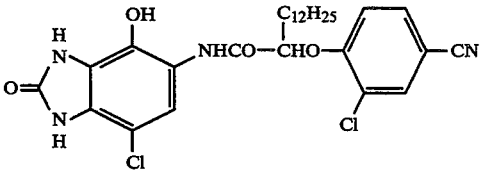

-continued
C-10
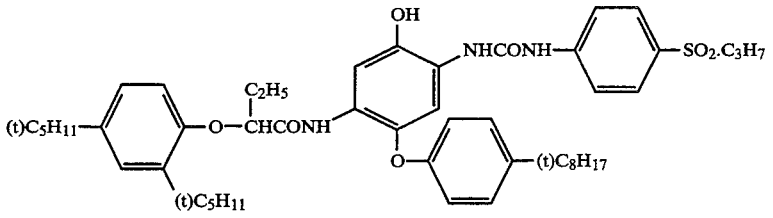
C-11
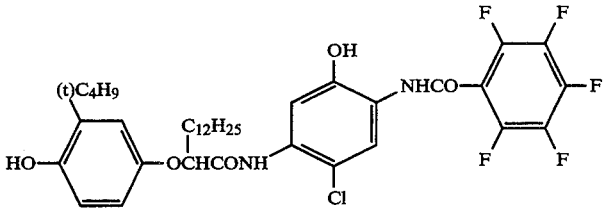
C-12
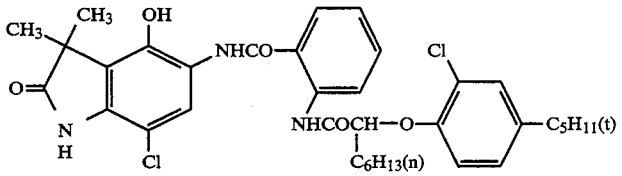
C-13
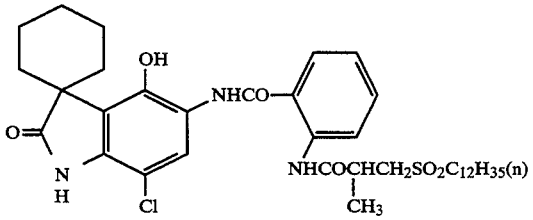
C-14
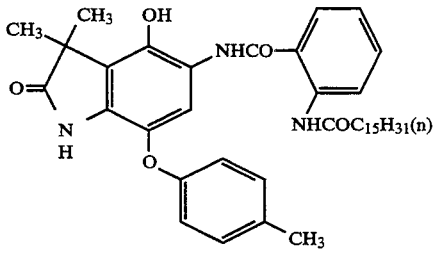
C-15
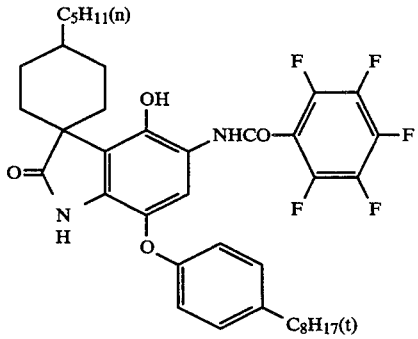

-continued
C-16
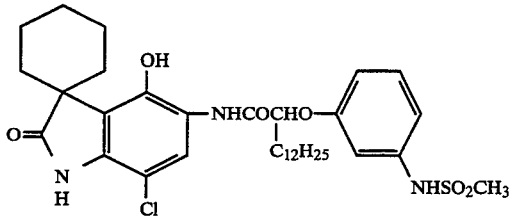
C-17
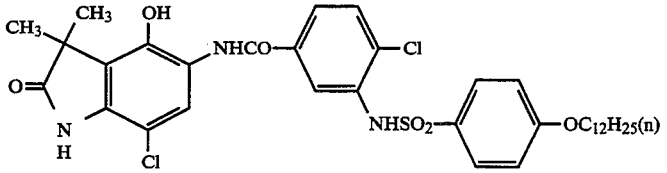
M-1
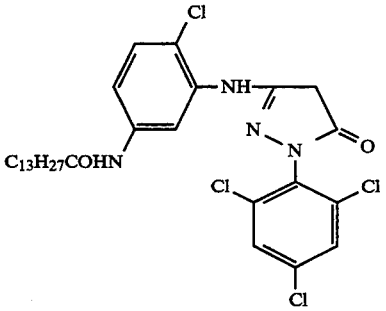
M-2
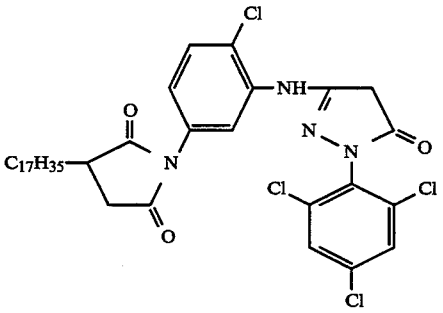
M-3
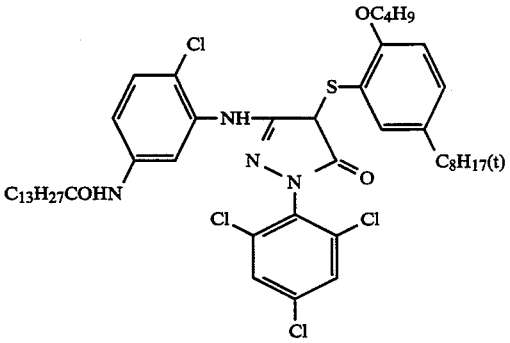

-continued
M-4
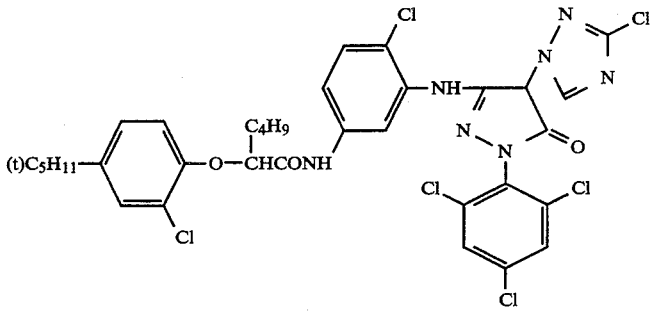
M-5
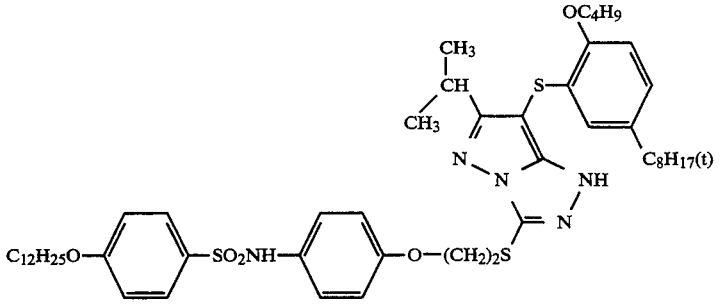
M-6
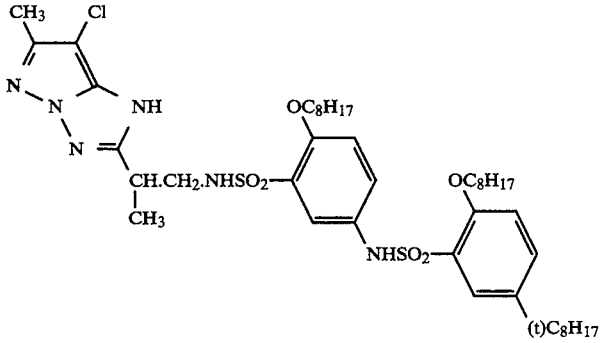
M-7
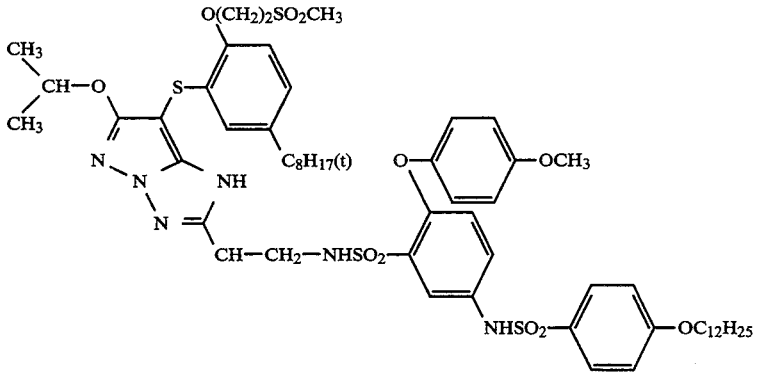
M-8
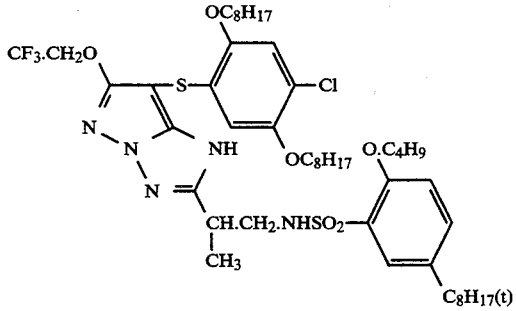

-continued
M-9
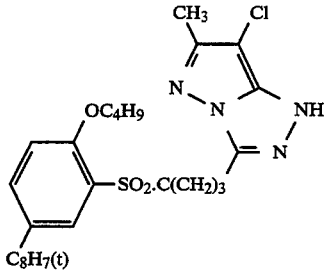
M-10
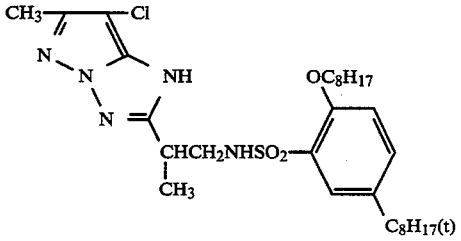
M-11
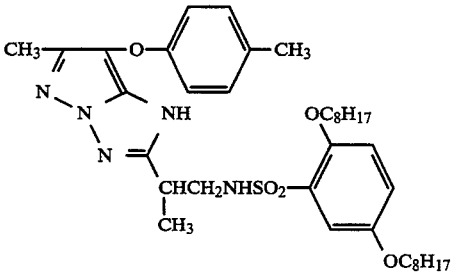
M-12
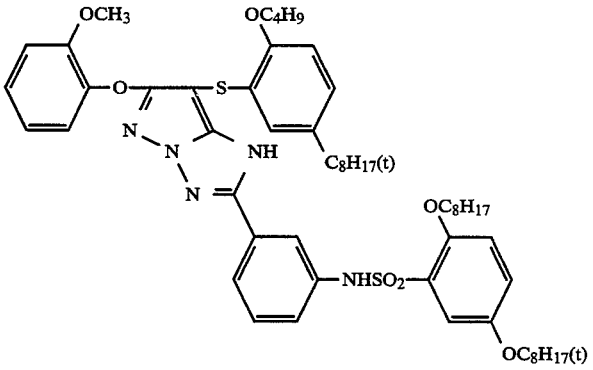
M-13
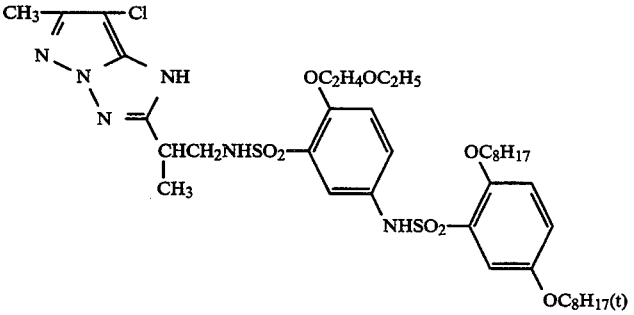

-continued
M-14
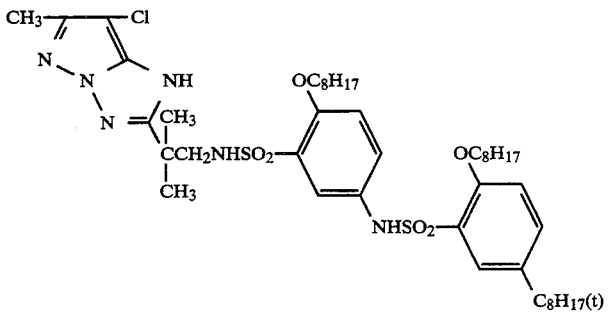
M-15
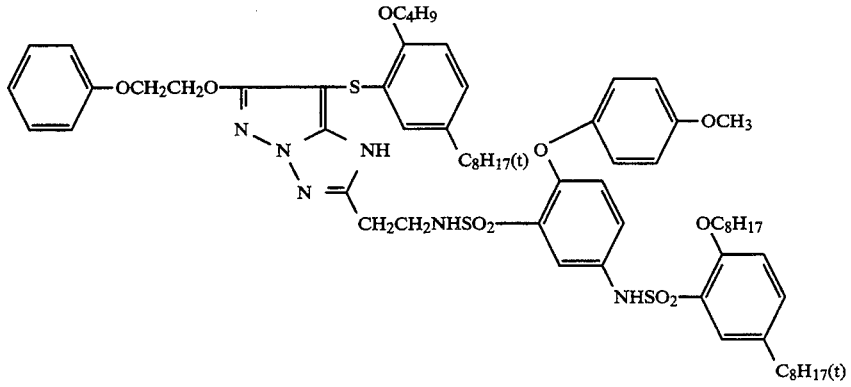
M-16
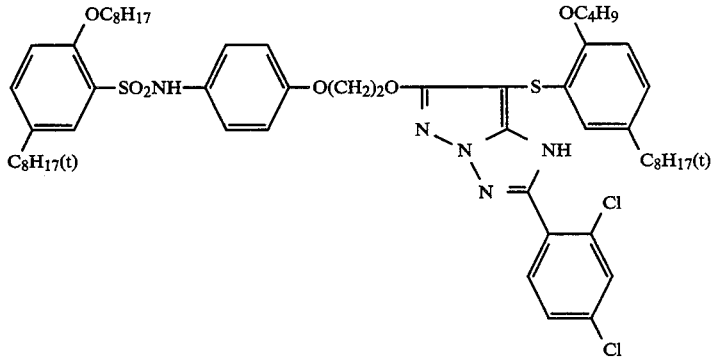
M-17
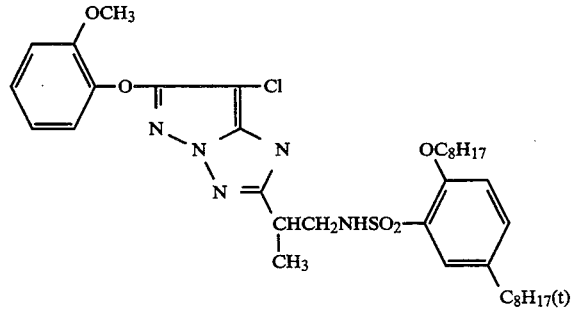

-continued
M-18
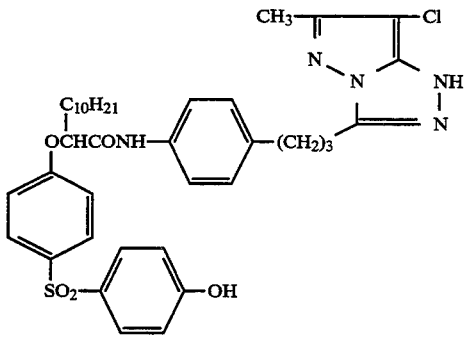
M-19
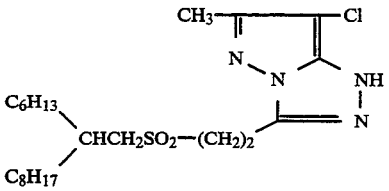
M-20
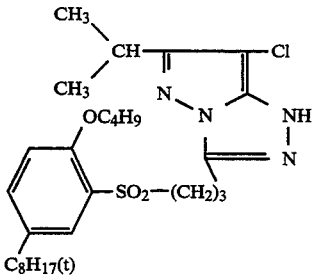
M-21
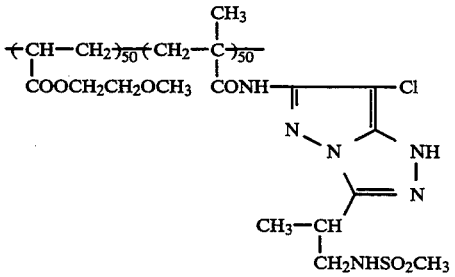
M-22
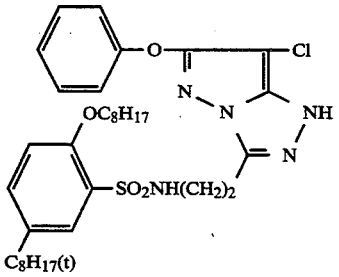

-continued
M-23
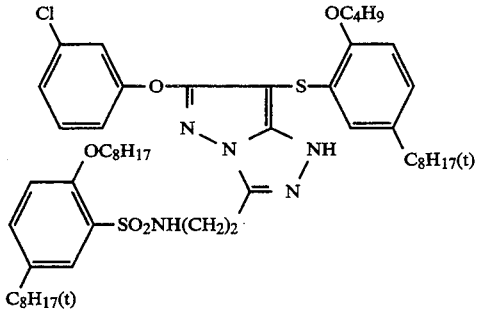
Y-1
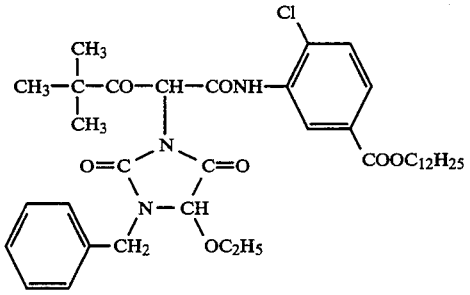
Y-2
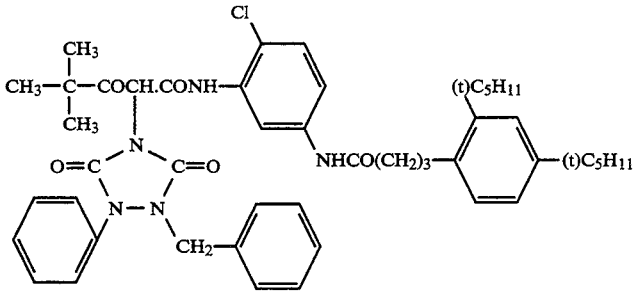
Y-3
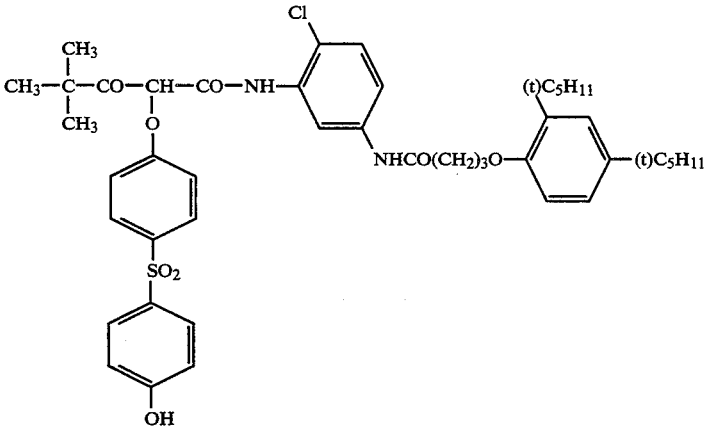
Y-4
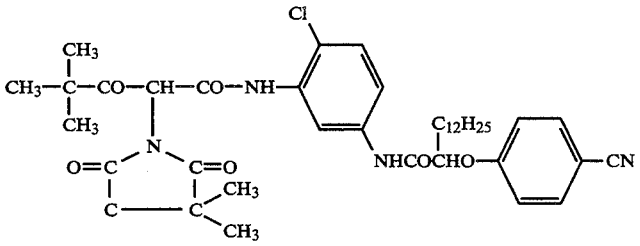

-continued

Y-5

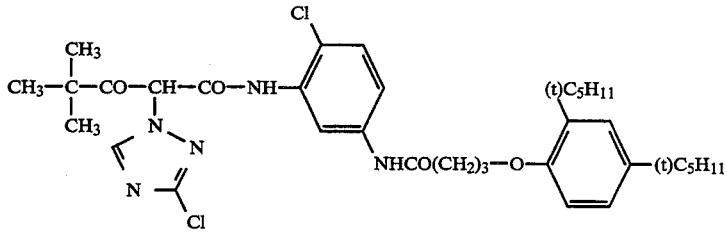

The generally used amount of the color coupler described above is in the range of from 0.001 to 1 mol per mol of light-sensitive silver halide, and preferably is from 0.01 to 0.5 mol for a yellow coupler, from 0.003 to 0.3 mol for a magenta coupler, and from 0.002 to 0.3 mol for a cyan coupler, per mol of light-sensitive silver halide.

In the silver halide color photographic material of this invention using the color couplers shown by formula (IV), (V), (VI), (VII) or (VIII) described above, the preferred amount of silver halide coated is not more than 3 $g/m^2$, preferably from 2 $g/m^2$ to 0.1 $g/m^2$ in the case of using a reflection support and preferably from 7 $g/m^2$ to 0.2 $g/m^2$ in the case of using a transparent support, calculated as silver.

These couplers are incorporated in silver halide emulsion layers as a dispersion in at least one high-boiling organic solvent. In this case, high-boiling organic solvents represented by following formula (A) to (E) are preferably used.

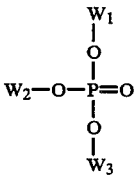

(A)

$W_1—COO—W_2$ (B)

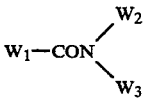

(C)

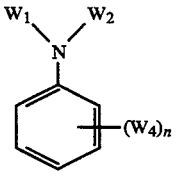

(D)

$W_1—O—W_2$ (E)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, $OW_1$, or $S—W_1$; and n represents an integer of from 1 to 5; when n is an integer of 2 or more $W_4S$ may be the same or different; and in formula (E), said $W_1$ and $W_2$ may combine and form a condensed ring.

The color photographic emulsions of this invention may further contain hydroquinone derivatives, aminophenol derivatives, amines, gallic acid derivatives, catechol derivatives, ascorbic acid derivatives, non-coloring couplers, sulfonamidophenol derivatives, etc., as color fogging preventing agentor color mixing preventing agents.

For the color photographic materials of this invention, fading preventing agents can be used. Typical examples of organic fading preventing agents are hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and the ether or ester derivatives obtained by silyling or alkylating the phenolic hydroxy groups of these compounds. Also, metal complexes such as (bissalicylaldoxymate) nickel complexes and (bis-N,N-dialkyldithiocarbamate) nickel complexes can be used.

Compounds having both moiety structures of hindered amine and hindered phenol in the same molecule as described in U.S. Pat. No. 4,268,593 can be used with good results for the prevention of the deterioration of yellow color images formed by heat, moisture and light. Also, spiroindanes described in Japanese Patent Application (OPI) No. 159644/81 and chouromans substituted by hydroquinone diether or monoether as described in Japanese Patent Application No. 89835/80 can be used with good results for preventing the deterioration of magenta dye images formed by, in particular light.

Furthermore, the image stabilizers described in Japanese Patent Application (OPI) No. 125732/84 can be particularly advantageously used for stabilizing magenta images formed using pyrazolotriazole type magenta couplers.

For improving storage stability, in particular light fastness of the cyan images formed, benzotriazole series ultraviolet absorbents are preferably used together. The ultraviolet absorbent may be co-emulsified with the cyan coupler.

The coating amount of the ultraviolet absorbent may be that sufficient for imparting light stability to cyan dye images but since if the amount thereof is too high, unexposed portions (background portions) of the color photographic material are sometimes yellowed, the amount thereof is usually in their range of from $1\times10^{-4}$ $mol/m^2$ to $2\times10^{-3}$ $mol/m^2$, and in particular, from $5\times10^{-4}$ $mol/m^2$ to $1.5\times10^{-3}$ $mol/m^2$.

Ultraviolet absorbents are incorporated in one of both layers adjacent cyan coupler-containing red-sensitive emulsion layer or, preferably in both the layers, in a conventional layer construction of color photographic paper. When ultraviolet absorbents are incorporated in an interlayer between a green-sensitive silver halide emulsion layer and a red-sensitive silver halide emulsion layer, the ultraviolet absorbents may be co-emulsified with color mixing preventing agents. Also, when ultraviolet absorbents are incorporated in a protective layer, another protective layer may be formed thereon as the outermost layer. The outermost protective layer may contain a matting agent with an optional particle size or a mixture of latexes having different particle sizes.

In the color photographic material of this invention, ultraviolet absorbents may be incorporated in hydrophilic colloid layer(s) as well.

When a reflection support, which can be used in this invention, is employed, it is preferred for color images formed in the silver halide emulsion layers to be viewed clearly and this is achieved by increasing the reflectivity of the support, examples of such supports include a support coated with a hydrophobic resin containing a light reflecting material such as titanium oxide, zinc oxide, calcium carbonate, calcium sulfate, etc., and a support composed of a vinyl chloride resin having a light reflective material dispersed therein. For example, there are haryta-coated papers, polyethylene-coated paper, poly-propylene series synthetic papers, transparent supports having formed thereon a reflective layer or containing therein a reflective material, this transparent support being polyester films such as polyethylene terephthalate films, triacetyl cellulose films, cellulose nitrate films, etc., polyamide films, polycarbonate films, polystyrene films, etc. These supports may be appropriately selected depending on use. Also, the supports having a mirror plane reflective surface or a second class diffusion reflective surface as described in Japanese Patent Application (OPI) No. 210346/85, Japanese Patent Application Nos. 168800/86 and 168801/86, etc.

Transparent supports can also be used in this invention. Transmittance of light of the transparent support is preferably not more than 50%.

This invention can be applied to a multilayer multicolor photographic light-sensitive material having at least two different spectral sensitivities on a support. A multilayer natural color photographic material usually has at least one red-sensitive silver hade emulsion layer, at least one green-sensitive silver halide emulsion layer, and at least one blue-sensitive silver halide emulsion layer on a support. The order of these layers can be optionally selected as desired. Also, each of the above-described silver halide emulsion layers may be composed of two or more silver halide emulsion layers having different light sensitivity or a light-insensitive layer may be present between two or more silver halide emulsion layers having the same color sensitivity.

It is preferred that the color photographic light-sensitive material of this invention has auxiliary layers such as protective layer(s), interlayers, a filter layer, antihalation layer(s), a backing layer, etc., in addition to silver halide emulsion layers on a support.

As a binder or a protective colloid which can be used for the emulsion layers and other hydrophilic colloid layers of the color photographic light-sensitive material of this invention, gelatin is advantageously used but other hydrophilic colloids can be also used.

Examples of suitable protective colloids are proteins such as gelatin derivatives, graft polymers of gelatin and other polymers, albumin, casein etc.; cellulose derivatives such as hydroxyethyl cellulose, carboxymethyl cellulose, cellulose sulfuric acid ester, etc.; saccharose derivatives such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Lime gelatin as well as acid-treated gelatin and enzyme-treated gelatin as described in *Bull, Soc. Sci. Phot. Japan*, No. 16, 30(1966) may be used as the gelatin and further the hydrolyzed products and the enzyme decomposition products of gelatin can be also used.

The color photographic materials of this invention may further contain various additives such as stabilizers, stain preventing agents, developing agents or precursors thereof, development accelerators or the precursors therefor, lubricants, mordants, matting agents, antistatic agents, plasticizers, and other photographically useful additives in addition to the above-described additives. Typical examples of these additives are described in *Research Disclosure*, No. 17643 (December, 1978) and ibid, No. 18716 (November, 1979).

The color photographic materials of this invention may further contain water-soluble dyes in the hydrophilic colloid layers as filter dyes or for irradiation prevention, halation prevention, and other various purposes.

Also, the color photographic materials of this invention may further contain stilbene series, triazine series, oxazole series, or coumarine series whitening agents in the photographic emulsion layers or other hydrophilic colloid layers. These whitening agents may be water-soluble or water-insoluble whitening agents may be used as the form of dispersion.

Another feature of this invention is quick stabilization of the color development process and in a color development process shorter than 3 minutes and 40 seconds, preferably shorter than 3 minutes, more preferably shorter than 2 minutes and 30 seconds. The reduced coating amount of silver halide is very useful not only for color development but also to improve the desilvering step.

An aromatic primary amino color developing agent which is used for a color developer in the case of developing the color photographic materials of this invention includes various color developing agents widely used in various color photographic processes. These color developing agents include aminophenol series derivatives and p-phenylenediamine series delivatives. Preferred examples of color developing agents are p-phenylenediamine derivatives and specific examples thereof are illustrated below without limiting, however, the color developing agents which can be used in this invention.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl)amino]-aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethyoxyethylaniline
D-11: 4-Amino-3-methyl-N-ethyl-N-β-ethyoxyethylaniline.

Also, these p-phenylenediamine derivatives may be salts thereof, such as sulfates, hydrochlorides, sulfites, p-toluenesulfonates, etc. The above-described compounds are described in U.S. Pat. Nos. 2,193,015, 2,552,241, 2,566,271, 2,592,364, 3,656,950, 3,698,525, etc.

The amount of the aromatic primary amine color developing agent used is from about 0.1 g to about 20 g, and preferably from about 0.5 g to about 10 g, per liter of color developer.

The color developer which is used in this invention may contain hydroxylamines.

The hydroxylamine may be used in the form of the free amine in the color developer but is generally used in the form of a water-soluble acid salt thereof. Examples of such salts are the sulfates, oxalates, hydrochlorides, phosphates, carbonates, acetates, etc. Hydroxylamines may be substituted or unsubstituted hydroxylamines, for example, the nitrogen atom of the hydroxylamine may be substituted with an alkyl group.

The addition amount of hydroxylamine is preferably from 0 to 10 g, and more preferably from 0 to 5 g, per liter of color developer. If the stability of color developer is maintained, the addition amount thereof preferably is as small as possible.

Also, it is preferred that the color developer contains sulfite such as sodium sulfite, potassium sulfite, sodium bisulfite, potassium bisulfite, sodium metasulfite, potassium metasulfite, or a carbonyl sulfuric acid addition product as a preservative. The addition amount thereof is preferably from 0 to 20 g/liter, and more preferably from 0 to 5 g/liter. The amount thereof preferably is as small as possible such that the stability of the color developer is maintained.

Other preservatives which can be used are aromatic polyhydroxy compounds described in Japanese Patent Application (OPI) Nos. 49828/77, 47038/81, 32140/81, 160142/84, and U.S. Pat. No. 3,746,544; hydroxyacetones described in U.S. Pat. No. 3,615,503 and British Patent 1,306,176; α-aminocarbonyl compounds described in Japanese Patent Application (OPI) Nos. 143020/77 and 89425/78; various metals described in Japanese Patent Application (OPI) Nos. 44148/82 and 53749/82; various saccharides described in Japanese Patent Application (OPI) No. 102727/77; α-α'-dicarbonyl compounds described in Japanese Patent Application (OPI) No. 160141/84; salicylic acids described in Japanese Patent Application (OPI) No. 180588/84; alkanolamines described in Japanese Patent Application (OPI) No. 3532/79; poly(alkyleneimines) described in Japanese Patent Application (OPI) No. 04349/81; gluconic acid derivatives described in Japanese Patent Application (OPI) No. 75647/81, etc.

These preservatives may be used as a mixture thereof if desired.

Particularly preferred preservatives are 4,5-dihydroxy-m-benzenedisulfonic acid, poly(ethyleneimine), and triethanolamine.

The pH of the color developer which is used for developing the color photographic materials of this invention is preferably form 9 to 12, and more preferably from 9 to 11.0. The color developer may further contain other compounds known as components for color developers.

To maintain aforesaid pH, a buffer is preferred, suitable buffers are carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1, 3-propanediol salts, valine salts, proline salts, trishydroxyaminomethane salts, lysine salts, etc. In particular, carbonates, phosphates, tetraborates, and hydroxybenzoates have the advantages that they have excellent solubility and also buffer action at high pH region of higher than 910, they are added to color developer without adversely influencing (fog, etc.,) photographic properties, and they are available at low cost and hence these buffers is particularly preferred.

Specific examples of these buffers are sodium carbonate, potassium carbonate, sodium bicarbonate, potassium bicarbonate, sodium tertiaryphosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the buffers for use in this invention are not limited to these compounds.

The addition amount of the buffer to the color developer is preferably more than 0.1 mol/liter, and particularly preferably from 0.1 mol/liter to 0.4 mol/liter.

Furthermore, color developers of this invention may contain various chelating agents as a precipitation preventing agent for calcium or magnesium, or for improving the stability of the color developers.

Suitable chelating agents are preferably organic acid compounds and examples thereof are aminopolycarboxylic acids described in Japanese Patent Publication Nos. 30496/73 and 30232/69, organic sulfonic acids described in Japanese Patent Application (OPI) No. 96347/81, Japanese Patent Publication No. 39359/81, and West German Patent 2,227,639, phosphonocarboxylic acids described in Japanese Patent Application (OPI) Nos. 102726/77, 42730/78, 121127/79, 126241/80, and 65956/80, and the compounds described in Japanese Patent Application (OPI) Nos. 195845/83, 203440/83, and Japanese Patent Publication No. 40900/78. Specific examples of chelating agents are illustrated below without limiting the chelating agents for use in this invention:

nitrilotriacetic acid,
diethyleneaminopentaacetic acid,
ethylenediaminetetraacetic acid,
triethylenetetraminehexaacetic acid,
N,N,N-trimethylenephosphonic acid,
ethylenediamine-N,N,N',N'-tetramethylenephosphonic acid,
1,3-diamino-2-propnaol-tetraacetic acid,
trans-cyclohexanediaminctetraacetic acid,
nitrilotripropionic acid,
1,2-diaminopropanetetraacetic acid,
hydeoxethyliminodiacetic acid,
glycol ether diaminetetraacetic acid,
hydroxyethylenediaminetriacetic acid,
ethylenediamine-o-hydroxyphenylacetic acid,
2-phosphonobutane-1,2-4-tricarboxylic acid,
1-hydroxyethane-1,1-diphopshonic acid, and
N,N'-bis(2-hydroxubenzyl)ethylenediamine-N,N'-diacetic acid.

These chelating agents may be, if desired, used as a mixture of two or more. The addition amount of the chelating agent may be that sufficient for blocking metal ions in the color developer and, for example, from 0.1 g to 10 g per liter of the color developer is a suitable amount.

The color developer may further contain, if described, a development accelerator.

Examples of development accelerator are thioether series compounds described in Japanese Patent Publications 16088/52, 5987/52, 7826/63, 12380/69, 9019/70, and U.S. Patent 3,813,247, p-phenylenediamine series compounds described in Japanese Patent Application (OPI) Nos. 49829/77 and 15554/75, quaternary ammonium salts described in Japanese Patent Application (OPI) Nos. 137726/75, 156826/81, and 43429/77, and Japanese Patent Publication No. 30074/69, p-aminophenols described in U.S. Pat. Nos. 2,610,122 and 4,119,462, amino series compounds described in U.S. Pat. Nos. 2,494,903 3,128,182, 4,230,796, 3,253,919, 2,482,546, 2,596,926, and 3,582,346, and Japanese Patent Publication No. 11431/66, polyalkylene oxides described in Japanese Patent Publication Nos. 16088/62, 25201/67, 11431/66, and 23882/67, and U.S. Pat. Nos. 3,128,183 and 3,532,501, and, further, 1-phenyl-3-pyrazolidones, hydrazines, meso-ion type compounds, thione type compounds, imidazoles, etc.

In particular, thioether series compounds and 1-phenyl-3-pyrazlidones are preferred.

The color developer used in this invention may further contain, if desired, optionally an antifoggant.

Suitable antifoggants are alkali metal halide such as potassium bromide, sodium chloride, potassium iodide, etc., or other organic antifoggants may be used on combination with the above-described compound shown by formula (XXI), (XXII), or (XXIII). Specific examples of organic antifoggants are nitrogen-containing heterocyclic compounds such as benzotriazole, 6-nitrobenzimidazole, 5-nitroisoindazole, 5methylbenzotriazole, 5-nitrobenzotriazole, 5-chloro-benzotriazole, 2-thiazolyl-benzimidazole, 2-thiazolylmethyl-benzimidazole, hydroxyazaindrizine, etc.; other mercapto-substituted heterocyclic compounds than those shown by formula (XXI), (XXII), or (XXIII) described above, such as 2-mercatobenzimidazole, 2-mercaptobenzothiazole, etc.; adenine; and further mercapto-substituted aromatic compounds such as thiosalicylic acid.

These antifoggants may be dissolved from the color photographic materials during processing and accumulated in the color developer but the accumulated amount is preferably less from the stand point of reducing the amount to be discharged.

It is also preferred for the color developer in this invention to contain an optical whitening agent. Examples of optical whitening agents are 4,4-diamino-2,2'-disulfostilbene series compounds and these preferred. The addition amount thereof is from 0 to 5 g/liter, and preferably from 0.1 g/liter to 2 g/liter.

Also, if desired, the color developer may contain a surface active agent such as an alkylsulfonic acid, an aryl-sulfonic acid, the aliphatic carboxylic acid, an aromatic carboxylic acid, etc.

The temperature of use of the color developer for developing the color photographic materials of this invention is preferably from 30° C. to 50° C., and more preferably from 30° C. to 42° C.

The replenishing amount for the color developer is less than 2,000 ml, and preferably less than 1,500 ml, per square meter of color photographic material but the replenishing amount is preferably less from the standpoint of reducing the amount of waste solution. For instance, the replenishing amount of color printing photographic material is generally 400 ml or less, more preferably 150 ml or less.

In this invention, for increasing the speed of the processing by a color developer without any benzyl alcohol, which is disadvantageous in the points of environmental contamination, storage stability of color images, and occurrence of stains, being present, it is preferred to use in the color development system a restoring agent for the oxidation product of a color developing agent and a trapping agent for the oxidation product of the restoring agent as described in Japanese Patent Application No. 259799/86.

Suitable bleaching agents for the bleach solution or blix (bleach-fix) solution which can be used for processing the color photographic materials after color development include ferric ion complexes. i.e., the complexes of ferric ions and a chelating agent such as an aminopolycarboxylic acid, an aminopolyphopshoric acid, or the salts thereof.

The aminopolycarboxyaltes or aminopolyphosphates are the salts of aminopolycarboxylic acids or aminopolyphosphoric acids and an alkali salt, ammonium salt, or a water-soluble amine salt are suitable.

Examples of alkali metal salts are sodium, potassium, lithium, etc., and examples of the water-soluble amine salts are salts of alkylamines such as methylamine, diethylamine, triethylamine, butrylamine, etc., alicyclic amines such as alkylamine, cyclohexylamine, etc., arylamines such as aniline, m-toluidine, etc., and heterocyclic amines such as pyridine, morpholine, piperidine, etc.

Typical examples of these aminopolycarboxylic acids, aminopolyphosphoric acids, and the salts thereof useful as chelating agents are;

ethylenediaminetetraacetic acid,
ethylenediaminetetraacetic acid disodium salt,
ethylenediaminetetraacetic acid diammonium salt,
ethylenediaminetetraacetic acid tetra(trimethylammonium) salt,
ethylenediaminetetraacetic acid tetra-potassium salt,
ethylenediaminetetraacetic acid tetra-sodium salt,
ethylenediaminetetraacetic acid tri-sodium salt,
ethylenediaminetetraacetic acid
diethylenetriaminepentaacetic acid,
diethylenetriaminepentaacetic acid penta-sodium salt,
ethylenediamine-N-(β-oxyethyl)-N,N',N'-triacetic acid,
ethylenediamine-N-(β-oxyethyl)-N,N',N'-triacetic acid tri-sodium salt,
ethylenediamine-N-(β-oxyethyl)-N,N',N'-triacetic triammonium salt,
propylenediaminetetraacetic acid,
propylenediaminetetraacetic acid disodium salt,
nitrilotriacetic acid,
nitrilotriacetic acid trisodium salt,
cyclohexanediaminetetraacetic acid,
cyclohexanediaminetetraacetic acid disodium salt,
iminodiacetic acid,
dihydroxyethylglycine,
ethyl ether diaminetetraacetic acid,
glycol ether diaminetetraacetic acid,
ethylenediaminetetrapropionic acid,
phenylenediaminetetraacetic acid,
1,3-diaminopropanol-N,N,N',N'-tetramethylenephosphonic acid,
ethylenediamine-N,N,N',N'-tetramethylenephoshonic acid,
1,3-propylenediamine-N, N', N'-tetramethylenephoshonic acid etc. tetramethylenephoshonic acid etc.

The ferric ion complex may be used in the form of a complex salt or may be formed in a solution using a ferric salt such as ferric sulfate, ferric chloride, ferric nitrate, ferric ammonium sulfate, ferric phosphate, etc., and a chelating agent such as aminopolycarboxylic acid, aminopolyphosphoric acid, phosphonocarboxylic acid, etc. In the case of use in the form of a complex salt, the complexes may be used along or as a mixture of two or more complexes. On the other hand, where the complex salts(s) are formed in solution using a ferric salt and a chelating agent, the ferric salts may be used alone or as a mixture of two or more kinds of ferric salts. Furthermore, the chelating agents may be used alone or as a mixture of two or more thereof. Also, in any cases, the chelating agent(s) may be used in an excessive amount to the amount of ferric ion complex formed. As the ferric complexes, aminopolycarboxylic acid ferric complexes are preferred and the addition amount thereof is from 0.01 to 1.0 mol/liter, and preferably from 0.05 to 0.50 mol/liter.

The bleach solution or the blix solution may, if desired, contain a bleach accelerator. Specific examples of useful bleach accelerators are compounds having a mercapto group or a disulfide group as described in U.S. Pat. No. 3,893,858, West German Patents 1,290,812, and 2,059,988, and Japanese Patent Application (OPI) Nos. 32736/78, 57831/78, 37418/78, 65732/78, 72623/78, 95630/78, 95631/78, 104232/78, 124424/78, 141623/78, 28426/78, *Research Disclosure*, No. 17129 (July, 1978), etc.; thiazolidine derivatives as described in Japanese Patent Application (OPI) No. 140129/75, thiourea derivatives described in Japanese Patent Publication No./8506/70, Japanese Patent Application (OPI) Nos. 20832/77 and 32735/78, and U.S. Pat. No. 3,706,561; iodides described in West German Patent 1,127,715, and Japanese Patent Application (OPI) No. 16235/83; polyethylene oxides described in West German Patents 966,410 and 2,748,430; polyamine compounds described in Japanese Patent Publication No. 8836/70; the compounds described in Japanese Patent Application (OPI) Nos. 42434/74, 59644/74, 94927/78, 35727/79, 26506/80, and 163940/83; and iodide ions, bromide ions, etc.

Of the aforesaid compounds, the compounds having a mercapto group or a disulfide group are preferred from the standpoint providing a large acceleration effect and the compounds described in U.S. Pat. No. 3,893,858, West German Patent 3,893,858, West German Patent 1,290,812, and Japanese Patent Application (OPI) No. 95630/78 are particularly preferred.

Furthermore, the bleach solution or the blix solution used in this invention may contain a re-halogenating agent such as a bromide (e.g., potassium bromide, sodium bromide, ammonium bromide, etc.), a chloride (e.g., potassium chloride, sodium chloride, ammonium chloride, etc.), or an iodide (e.g., ammonium iodide). Also, the bleach solution or blix solution may further contain, if desired, a corrosion preventing agent, e.g., inorganic acids, organic acids, and alkali metal or ammonium salts thereof each having a pH buffer capability, such as boric acid, borax, sodium metaborate, acetic acid, sodium acetate, sodium carbonate, potassium carbonate, phopshorous acid, phosphoric acid, sodium phosphate, citric acid, sodium citrate, tartaric acid, ammonium nitrate, etc., or guanidine, etc.

Suitable fixing agents for the blix solution or the fix solution which is used in this invention are thiosulfates such as sodium thiosulfate, ammonium thiosulfate, etc.; thiocyanates such as sodium thiocyanate, ammonium thiocyanate, etc.; thioether compounds such as ethylenebis-thioglycolic acid, 3,6-diethia-1,8-octanediol, etc.; and water-soluble silver halide solvents such as thioureas, etc. They can be used alone or as a mixture thereof.

Also, a specific blix solution containing fixing agent and a large amount of a halide such as potassium iodide described in Japanese Patent Application (OPI) No. 155354/80 can be used. In this invention, the use of a thiosulfate, in particular ammonium thiosulfate is preferred.

The amount of the fixing agent is preferably from 0.3 mol/liter to 2 mols/liter, and more preferably from 0.5 mol/liter to 1.0 mol/liter.

The pH range of the blix solution or fix solution used in this invention is preferably 3 to 10, and more preferably from 4 to 9. If the pH is lower than the aforesaid range, the deterioration of the solution and the formation of leuco compound from cyan dyes are accelerated although desilvering may be improved. Also, if the pH is higher than the range, desilvering is delayed and stain tends to form.

To control the pH, sulfuric acid, nitric acid, acetic acid (glacial acetic acid), bicarbonate, ammonia, potassium hydroxide, sodium hydroxide, sodium carbonate, potassium carbonate, etc., may be added thereto to control the pH.

Also, the blix solution may further contain an optical whitening agent, a defoaming agent, a surface active agent, and an organic solvent such as polyvinylpyrrolidone, methanol, etc.

Furthermore, the blix solution or fix solution in this invention contains a sulfite ion-releasing compound such as a sulfite (e.g., sodium sulfite, potassium sulfite, and ammonium sulfite), a bisulfite (e.g., ammonium bisulfite, sodium bisulfite, and potassium bisulfite), a metabisulfite (e.g., potassium metabisulfite, sodium metabisulfite, and ammonium bisulfite), etc., as a preservative. The amount of the preservative is preferably from about 0.02 mol/liter to 0.05 mol/liter, and more preferably from about 0.04 to 0.40 mol/liter calculated as sulfide ions.

As the preservative, a sulfite is generally used but ascorbic acid, a carbonyl bisulfurous acid addition product, a carbonyl compound, etc., may be used together with the sulfite.

Furthermore, the blix solution or the fix solution may contain, if necessary, a buffer agent, an optical whitening agent, a chelating agent, an antifungal agent, etc.

It is preferred to use at least one of ion (III) complex salts of ethylenediaminetetraacetic acid, ion (III) complex salts of diethylenetriaminepentaacetic acids, and ion (III) complex salts of cyclohexanediaminetetraacetic acids for the blix solution or the bleach solution in this invention.

The wash step in this invention is explained below.

In this invention, a simple "stabilization processing" only without substantially employing wash step in place of ordinary "wash processing" can be employed. Thus, "wash processing" in this invention is used in the broad meaning as described above.

The amount of washing water is not easily defined since the amount depends upon the number of tanks for multistage countercurrent washing and the amount of the bleaching component carried by the color photographic materials from prior baths but the bleach and fix components may be carried to the final wash bath or tank. For example, in the case of a 3-tank countercurrent washing, the amount of wash water is preferably more than about 1,000 ml, more preferably more than 5,000 ml, per square meter of color photographic material. Also, in the case of water saving processing, it is better to use water in an amount of from 100 ml to 1,000 ml per square meter of color photographic material.

The washing temperature is usually from 15° C. to 45° C., and preferably from 20° C. to 35° C.

Wash water from the wash step may contain various compounds for preventing precipitation and stabilizing wash water. For example, chelating agents such as inorganic phosphonic acids, aminopolycarboxylic acids, organic phosphoric acids, etc., antibacterial or antifungal agents for preventing the growth of various bacteria, algae, and molds, such as the compounds described in *Journal of Antibacterial and Antifungal Agents*, Vol. 11, No. 5, 207–223(1983) and the compounds described in Hiroshi Horiguchi, *Bokin Bobai no Kagaku* (*Antibacterial and Antifungal Chemistry*), metal salts such as magnesium salts and aluminum salts, alakali metal salts, ammonium salts, and surface active agents can be present. Moreover, the compounds described in *Journal of Photographic Science and Engineering*. Vol. 6, 344–359(1065) may be added thereto.

Further, water from which calcium compounds and magnesium compounds are deleted, which is described in Japanese Patent Application No. 133632/61, may be used as a wash water instead of antifungal.

This invention is particularly effective in greatly saving the amount of wash water by adding a chelating agent, an antibacterial agent, and an antifungal agent to the wash water and by employing multistage countercurrent washing using two or more tanks. Also, the invention is effective in practicing multistage countercurrent stabilization processing (so-called stabilization processing) as described in Japanese Patent Application (OPI) No. 8543/82 in place of an ordinary wash step. In these cases, the blix component in the final bath may be $5\times10^{-2}$ or less, and preferably $1\times10^{-2}$.

The stabilization solution in this invention contains various compounds for stabilizing color images formed. For example, various additives such as various buffers for controlling the pH (e.g., pH 3 to 8) of the photographic layers (e.g., borates, metaborates, borax, phosphates, carbonates, potassium hydroxide, sodium hydroxide, aqueous ammonia, monocarboxylic acids, dicarboxylic acids, polycarboxylic acids, etc., as a combination thereof) and an aldehyde such as form aldehyde can be present. Other additives for the stabilizing solution are chelating agents (e.g., inorganic phosphoric acids, aminopolycarboxylic acids, organic phosphonic acids, aminopolyphosphonic acids, phosphonocarboxylic acids, etc.), sterilizers (e.g., thiazole series sterilizers, isothiazole series sterilizers, halogenated phenols, sulfonylamide, benzotriazole, etc.), surface active agents, optical whitening agents, hardening agents, etc. They may be used as a mixture two or more of the same kind or different kinds of additives.

Also, it is preferred to improve the storage stability of the color images obtained to add various ammonium salts such as ammonium chloride, ammonium nitrate, ammonium sulfate, ammonium phoshate, ammonium sulfite, ammonium thiosulfate, etc., to the stabilization solution as a pH controlling agent for the processor.

In greatly saving the amount of wash water as described above, it is preferred to reduce the amount of waste solution that a part or all of the overflow solution of the wash water is supplied to a blix bath or fix bath, which is a pre-bath.

In continuously performing the process step in this invention, a constant finish is obtained by preventing a change in the composition of each processing solution using a replenisher for each processing solution. The amount of each replenisher can be reduced to a half or less than a half of the standard amount of the replenisher for a reduction in cost.

Each processing bath may be, if desired, equipped with a heater, a temperature sensor, a liquid level sensor, a circulation pump, a filter, a floating lid, a squeegee a nitrogen gas stirrer, an air stirrer, etc.

For the color photographic materials of this invention can be applied any processing using color developer. For example, photographic processing for color photographic papers, color reversal photographic papers, color positive photographic films, color negative photographic films, color reversal photographic film, etc., can be employed.

The following examples serve to illustrate this invention more practically without limiting, however, the scope of the invention. Unless otherwise indicated, all parts, percents, ratios and the like are by weight.

EXAMPLE 1

Silver halide emulsion (A) was prepared by the following manner.

| | |
|---|---|
| Solution 1 | |
| Water | 1,000 ml |
| Sodium Chloride | 5.5 g |
| Gelatin | 32 g |
| Solution 2 | |
| Sulfuric Acid (1N) | 24 ml |
| Solution 3 | |
| Compound A shown below (aq. 1% soln.) | 3 ml |

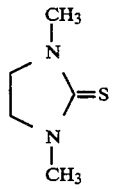

| | |
|---|---|
| Solution 4 | |
| Sodium Chloride | 11.00 g |
| Water to make | 200 ml |
| Solution 5 | |
| Silver Nitrate | 32.00 g |
| Water to make | 200 ml |
| Solution 6 | |
| Sodium chloride | 44.00 g |
| $K_2IrCl_6$ (0.001% soln.) | 2.3 ml |
| Water to make | 560 ml |
| Solution 7 | |
| Silver Nitrate | 128 g |
| Water to make | 560 ml |

After heating Solution 1° to 52° C., Solution 2 and Solution 3 were added to the solution.

Thereafter, Solution 4 and Solution 5 were simultaneously added to the mixture thus formed over a period of 14 minutes. After furthermore 10 minutes, Solution 6 and Solution 7 were simultaneously added to the mixture obtained over a period of 15 minutes. Five minutes after the addition, the temperature of the system was lowered and desalting was carried out. Then, water and a gelatin dispersion were added thereto and the pH thereof was adjusted to 6.2 to provide a monodisperse cubic grain silver chloride emulsion having a mean grain size of 0.48 μm and a variation coefficient of 0.10

(a value obtained by dividing a standard deviation by an average grain size).

After adding to the emulsion sodium thiosulfate and applying thereto optimum chemical sensitization at 58° C. the above described CR compound (CR-24) was added to the emulsion at $4\times10^{-4}$ mol per mol of silver halide to achieve spectral sensitization. Also, a stabilizer [(XXI)-(7)] was added thereto at $5\times10^{-4}$ mol per mol of silver halide. Thus, Emulsion (A) was prepared.

By following the same procedure as the case of preparing Emulsion (A) except that after the addition of Solution 6 and Solution 7, Solution 8 shown below was added to the mixture over a period of 10 minutes and after 5 minutes since then, the temperature of the system was lowered, Emulsion (B) was obtained.

| Solution 8 | |
|---|---|
| Potassium Bromide | 5.60 g |
| Water to make | 280 ml |

By following the same procedure as the case of preparing Emulsion (A) except that Solution 9 and Solution 10 shown below were added over a period of 15 minutes in place of adding Solution 6 and Solution 7, after 10 minutes after the addition, Solution 11 and Solution 12 shown below were further added to the mixture over a period of 5 minutes, and after 5 minutes since then, the temperature of the system was lowered, Emulsion (C) was obtained.

| | |
|---|---|
| Solution 9 | |
| Sodium Chloride | 41.28 g |
| $K_2IrCl_6$ (0.001% soln.) | 2.3 ml |
| Water to make | 525 ml |
| Solution 10 | |
| Silver Nitrate | 120 g |
| Water to make | 525 ml |
| Solution 11 | |
| Potassium Bromide | 5.60 g |
| Water to make | 100 ml |
| Solution 12 | |
| Silver Nitrate | 8.00 g |
| Water to make | 100 ml |

Then, by following the same procedure as the case of preparing Emulsion (C) except that Solution 13 and Solution 14 shown below were used in place of Solution 11 and Solution 12, Emulsion (D) was obtained.

| | |
|---|---|
| Solution 13 | |
| Potassium Bromide | 4.48 g |
| Sodium Chloride | 0.55 g |
| Water to make | 100 ml |
| Solution 14 | |
| Silver Nitrate | 8.00 g |

-continued

| | |
|---|---|
| Water to make | 100 ml |

Then, by following the same procedure as the case of preparing Emulsion (A) except that the super fine grain silver bromide emulsion (having mean grain size of 0.05 μm) described above was added to the mixed emulsion in an amount of containing 1 mol % of silver bromide to silver chloride before applying the chemical sensitization to the emulsion and then the resultant emulsion was ripened for 10 minutes at 58° C., Emulsion (E) was obtained.

Furthermore, by following the same procedure as the case of preparing Emulsion (E) except that the CR compound (CR-24) was added at $4.0\times10^{-4}$ mol per mol of silver halide before adding the super fine grain silver bromide emulsion, Emulsion (F) was obtained.

The characteristics of the emulsion (A) to (F) are shown in the Table below.

Then, 100 g of a magneta coupler (M-(1) described hereinbefore) was dissolved in a mixed solvent of 130 ml of a solvent (Solv-2) and 100 ml of ethyl acetate together with 80 g of a color image stabilizer (Cpd-3) and 38 g of a color image stabilizer (Cpd-4) and the solution was dispersed by emulsification in 1200 g of a aqueous 10% gelatin solution containing 4.0 g of sodium dodecylbenzenesulfonate to provide an emulsified dispersion (I-1).

The chemical structures of the compounds used are as follows.

(Cpd-3) Color image stabilizer

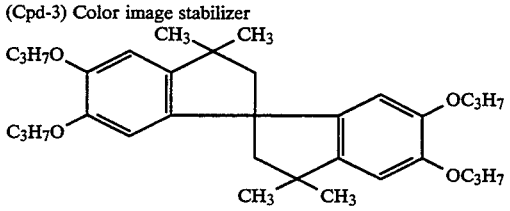

(Cpd-4) Color image stabilizer

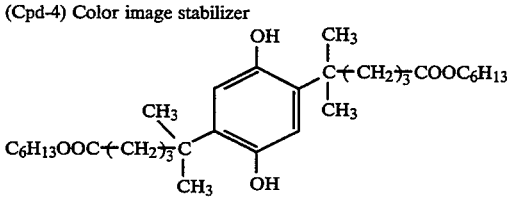

(Solv-2) Solvent

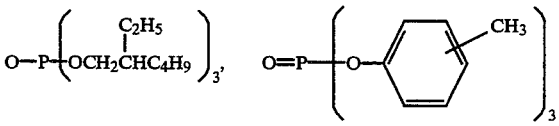

1:1 mixture of (volume ratio)

TABLE 1

| Emulsion | Average Halogen Proportion AgBr (mol %) | AgCl (mol %) | Average AgBr (Content) | Maximum Content* of AgBr | Position** |
|---|---|---|---|---|---|
| A | 0 | 100 | 0 | 0 | Not present |
| B | 5 | 95 | 14 | about 70 mol % | Corner of the cubic |
| C | 5 | 95 | 15 | about 50 mol % | " |
| D | 4 | 96 | 14 | about 40 mol % | " |
| E | 1 | 99 | 12 | about 50 mol % | " |

TABLE 1-continued

| Emulsion | Average Halogen Proportion AgBr (mol %) | AgCl (mol %) | Average AgBr (Content) | Maximum Content* of AgBr | Position** |
|---|---|---|---|---|---|
| F | 1 | 99 | 5 | about 50 mol % | " |

*Maximum content of AgBr contained in a phase of high content of AgBr.
**Position where a phase of high content of AgBr is present.
Average surface halogen proportion, maximum AgBr content in the AgBr containing layer and the position of the phase of high content of AgBr, was each obtained by XPS method, X-ray diffraction method, and electron microscope and EDX method, respectively.

TABLE 2

| Sample | Support | Green sensitive emulsion layer: Emulsion (Ag: 400 mg/m$^2$) | Emulsified dispersion | Protective layer | |
|---|---|---|---|---|---|
| Sample 101 | Paper support | Emulsion (A) | Emulsion dispersion I-1 | Gelatin | Comparison |
| Sample 102 | laminiated | Emulsion (B) | Magenta coupler (E × $M_1$) | coverage | Present Invention |
| Sample 103 | with | Emulsion (C) | 350 mg/m$^2$ Fading preventing | 1500 mg/m$^2$ | " |
| Sample 104 | polyethylene | Emulsion (D) | agent (Cpd-3) 280 mg/m$^2$ | | " |
| Sample 105 | on both | Emulsion (E) | (Cpd-4) 133/m$^2$ Coupler solvent | | " |
| Sample 106 | surfaces | Emulsion (F) | (Solv-2) 0.455 ml/m$^2$ Gelatin | | " |
| | | | was added so as to obtain gelatin coverage of 1500 mg/m$^2$. | | |

Thus, 6 kinds of samples shown in Table 2 below were prepared.

In this case, the polyethylene layer on the support at the emulsion layer carrying side contained titanium dioxide and a slight amount of ultramarine blue. Also, 1-oxy-3,5-dichloro-s-triazine sodium salt was used for each layer as a hardening agent.

For determining the photographic properties of the coated samples thus obtained, the following experiment was carried out.

First, each sample was subjected to a sensitometric gradation exposure through a green filter using an actionmeter (FWF type, made by Fuji Photo Film Co., Ltd., color temperature of light source 3200° K.). The light exposure in this case was applied at an exposure time of 1/10 sec. and at an exposure amount of 250 CMS.

Thereafter, the samples thus exposed were processed as follows (Processing 1)

| Processing Step | Temperature | Time |
|---|---|---|
| Color Development | 35° C. | 45 sec. |
| Blix | 35° C. | 45 sec. |
| Wash | 28 to 35° C. | 45 sec. |

The compositions of the processing solutions used were as follows.

| Color Developer | |
|---|---|
| Triethanolamine | 8.12 ml |
| N,N-Diethylhydroxylamine | 4.93 ml |
| Optical Whitening agent 4,4'-diaminostilbene, (UVITEX CK trade name, made by Ciba-Geigy Corporation) | 2.80 g |
| 4-Amino-3-methyl-N-ethyl-N-[β-(methanesulfonamido)ethyl]-p-phenylenediamine Sulfate | 4.96 g |
| Sodium, Sulfite | 0.13 g |
| Sodium, Carbonate | 18.40 g |
| Potassium Hydrogen Carbonate | 4.85 g |
| EDTA.2Na.2$H_2O$ | 2.20 g |
| Sodium Chloride | 1.36 g |
| Water to make | 1,000 ml |
| | pH = 10.05 |

-continued

| Blix Solution | |
|---|---|
| Ammonium Thiosulfate (54 wt. %) | 103.0 ml |
| $NH_4$ [EDTA.Fe] | 54.10 g |
| EDTA.2Na.2$H_2O$ | 3.41 g |
| Sodium Sulfite | 16.71 g |
| Glacial Acetic acid | 8.61 g |
| Water to make | 1000 ml |
| | pH = 5.44 |

After processing the color density of each sample was measured and the sensitivity and gradation thereof were determined. The sensitivity was defined as the reciprocal of the exposure amount of giving a coloring density of fog density +0.5 and was shown by the relative value with the sensitivity of Sample 101 being defined as 100. Also, the gradation was shown by the difference between the logarithm of the exposure amount of giving a coloring density of 0.5 and the logarithm of the exposure amount of giving a coloring density of 2.0.

The results are shown in Table 3 below.

TABLE 3

| Sample | Sensitivity | Gradation | Notes |
|---|---|---|---|
| 101 | 100 | 0.56 | Comparison |
| 102 | 235 | 1.55 | Present Invention |
| 103 | 342 | 1.32 | " |
| 104 | 331 | 1.28 | " |
| 105 | 370 | 1.11 | " |
| 106 | 398 | 1.57 | " |

From the results shown in Table 3 above, it can be clearly seen that by using the silver halide emulsions of this invention, high-speed photographic materials are obtained as compared with the case of using comparison emulsions, especially Sample 106 provides high-sensitivity and hard contrast.

EXAMPLE 2

A multilayer color photographic paper having the layer structure shown below on a paper support, both surfaces of which were coated with polyethylene, was prepared.

Each coating solution was prepared by mixing each silver halide emulsion, various chemicals, and an emulsified dispersion of coupler. The preparation methods are shown below.

Preparation of Coupler Emulsified Dispersion

In mixture of 27.2 ml of ethyl acetate and 7.7 ml of a solvent (Solv-1) were dissolved 19.1 g of a yellow coupler (ExY) and 4.4 g of a color image stabilizer (Cpd-1) and the solution was dispersed by emulsification in 185 ml of an aqueous 10% gelatin solution containing 8 ml of a solution of 10% sodium dodecylbenzenesulfonate.

By the similar manner as above, the emulsified dispersion for each of a magenta coupler, a cyan coupler, and an intermediate layer was prepared.

The compounds used for each emulsion were as follows.

(ExY) Yellow Coupler

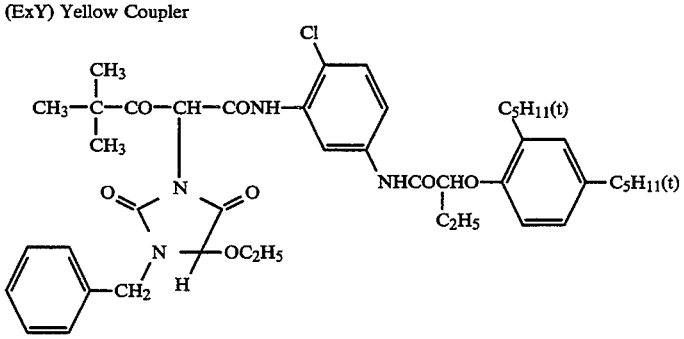

Magenta Coupler
(ExM-1) Same as above M-(1)
(ExM-2) same as above M-(3)
(ExM-3)

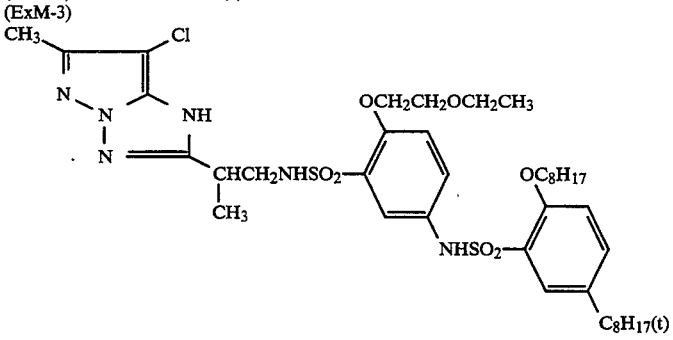

(ExM-4)

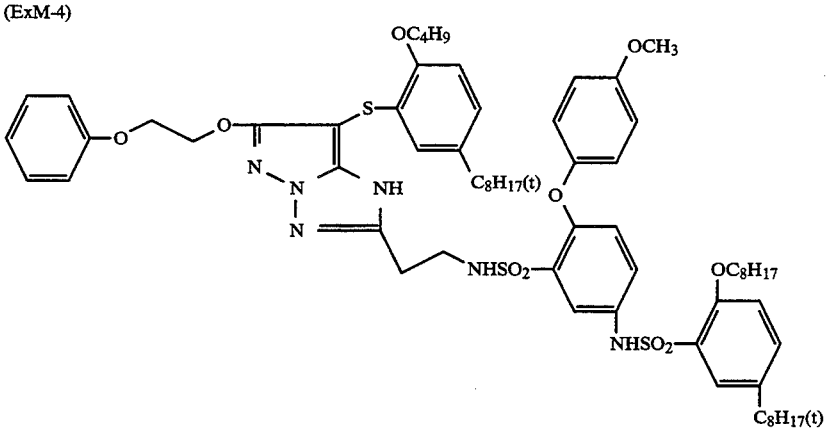

(ExC-1) Same as above C-(1)
(ExC2)

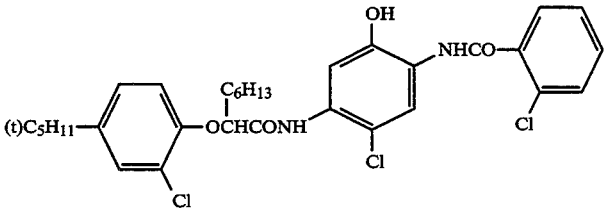

(ExC3)

-continued
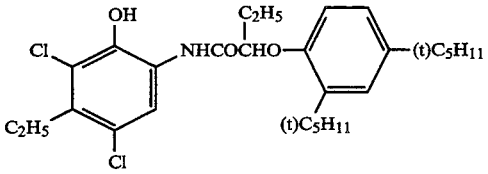
(ExC4)
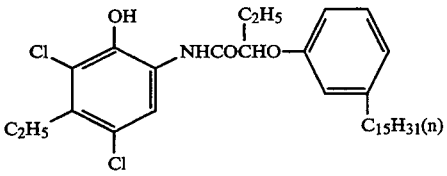
(ExC5)
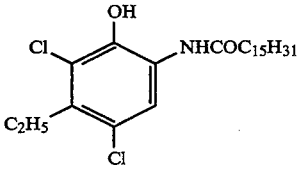
(Cpd-1) Color Image Stabilizer
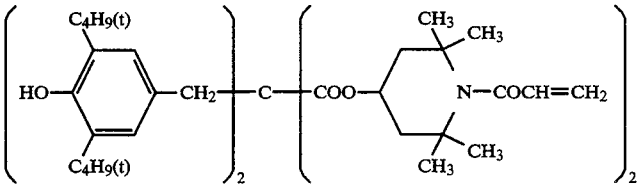
(Cpd-2) Color Mixing Preventing Agent
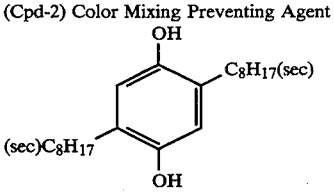
(Cpd-3) Color image stabilizer
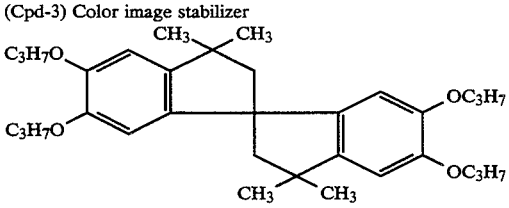
(Cpd-4) Color image stabilizer
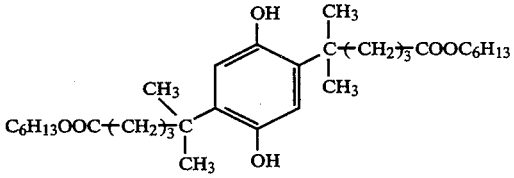
(Cpd-5) Color Mixing Preventing Agent
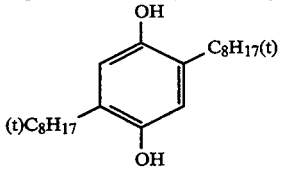

(Cpd-6) Color Image Stabilizer

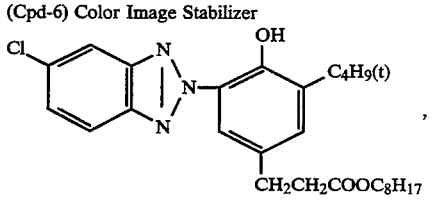

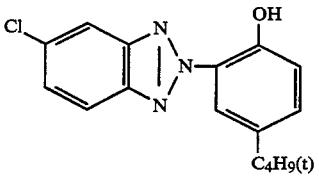

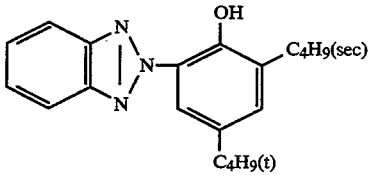

Mixture of 5:8:9 (by weight)

(Cpd-7) Polymer $\leftarrow CH_2-\underset{\underset{CONHC_4H_9(t)}{|}}{CH_2}\rightarrow_n$ Average Molecualr Weight 80,000

(UV-1) Ultraviolet Absorbent

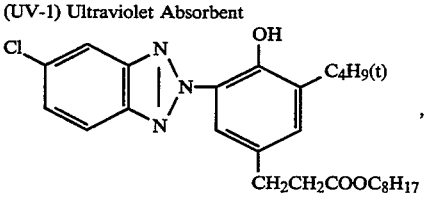

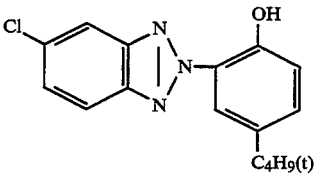

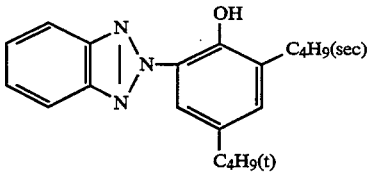

Mixture of 2:9:8 (by weight)

(Solv-1) Solvent

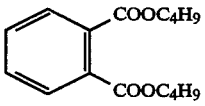

(Solv-2) Solvent

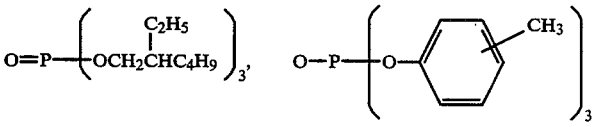

1:1 mixture (volume ratio)

(Solv-3) Solvent $O{=}P\leftarrow O-C_9H_{19}(iso))_3$ (Solv-4) Solvent

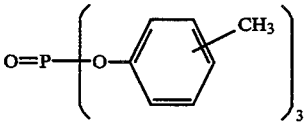

A Stabilizer [(XXI)-(7) described above] at $2.5\times10^{-4}$ mol per mol of silver halide for the blue-sensitive emulsion layer was used.

For each layer 1-oxy-3-5-dichloro-s-triazine sodium salt was used as a hardening agent.

Also, the following dyes were added to the emulsion layers for irradiation prevention.

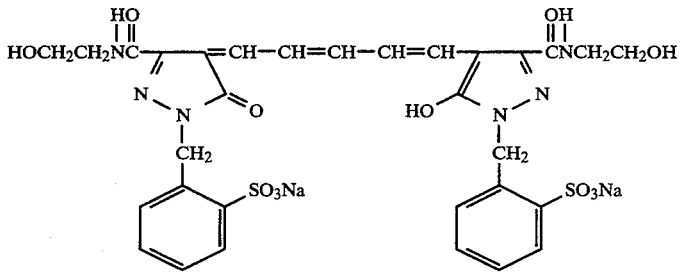

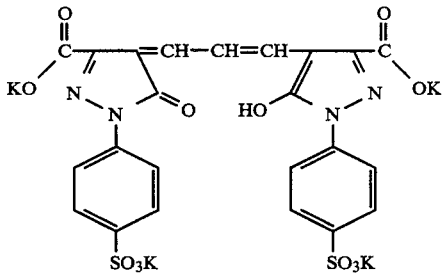

Also, the following compound was added to the red-sensitive emulsion layer at $2.6\times10^{-3}$ mol per mol of silver halide.

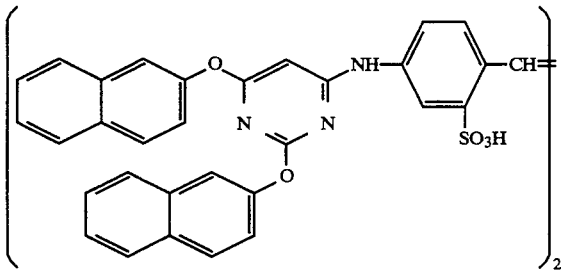

The preparation methods for the silver halide emulsions used in this example are explained below.

For the blue-sensitive emulsion, Emulsion (G) prepared according to the following procedure was used as the emulsion of this invention.

For the green-sensitive emulsion, Emulsion (A) and (F) prepared in Example (1) were used.

For the red-sensitive emulsion, the following Emulsions (I) and (J) were used. That is, by following the same procedure as the cases of preparing Emulsions (A) and (F) for the green-sensitive emulsion except that the sensitizing dye used as the CR compound was changed to CR-32 and the addition amount was $1.5\times10^{-4}$ mol per mol of silver halide.

The emulsion was mixed with each emulsified dispersion of coupler and the mixture was coated as shown in Table 4. Thus, Samples 201 to 208 were prepared. In this case, the couplers were replaced with each other on an equimolar basis.

The preparation of emulsions (G) and (H) were carried out as follows.

Formation of host silver chloride grains:

| | |
|---|---|
| Solution 1 | |
| Water | 1,000 ml |
| Sodium Chloride | 5.5 g |
| Gelatin | 32 g |

-continued

| | |
|---|---|
| Solution 2 | |
| Sulfuric Acid (1N) | 24 ml. |
| Solution 3 | |
| Compound A shown below (aq. 1% soln.) | 3 ml |
| Solution 4 | |
| Sodium Chloride | 1.7 g |
| Water to make | 200 ml |
| Solution 5 | |
| Silver Nitrate | 5 g |
| Water to make | 200 ml |
| Solution 6 | |
| Sodium Chloride | 41.3 g |
| $K_2IrCl_6$ (0.001% soln.) | 0.5 ml |
| Water to make | 600 ml |
| Solution 7 | |
| Silver Nitrate | 120 g |
| Water to make | 600 ml |

After heating Solution 1° to 76° C., Solution 2 and Solution 3 were added to the solution.

Thereafter, Solution 4 and Solution 5 were simultaneously added to the mixture thus formed over a period of 10 minutes.

Ten minutes later, Solution 6 and Solution 7 were simultaneously added to the mixture over a period of 35 minutes and 5 minutes after the addition, the temperature of the system was lowered and desalting was carried out. Then, water and a gelatin dispersion was added to the mixture and the pH thereof was adjusted to 6.3 to provide a monodisperse cubic grain silver chloride emulsion having a mean grain size of 1.1 μm and a variation coefficient of 0.10.

The emulsion thus formed was split into two equal-volume portions. To one of them were added a 0.6% solution of a blue spectral sensitizing dye (CR-7 described above) in an amount of 1.26 ml as the CR compound and further a fine grain silver bromide emulsion having a mean grain size of 0.05 μm in an amount of 0.5 mol % to the host silver chloride emulsion, and the mixed emulsion was ripened for 10 minutes at 58° C. Thereafter, sodium thiosulfate was added to the emulsion to apply thereto optimum chemical sensitization and the aforesaid stabilizer [(XXI)-(7)] was added thereto at $10^{-4}$ mol/mol-Ag to provide Emulsion (G).

The remaining portion of the emulsion containing no CR compound nor AgBr super-fine grain emulsion, etc., was defined as Emulsion (H).

TABLE 4

| Sample | First layer Emulsion | First layer Coupler | Third layer* Emulsion | Third layer* Coupler | Fifth layer Emulsion | Fifth layer Coupler |
|---|---|---|---|---|---|---|
| 201 | (H) | E × Y | (A) | E × $M_1$ | (I) | E × $C_1$ and $C_2$ (1:1) |
| 202 | (G) | E × Y | (F) | E × $M_1$ | (J) | E × $C_1$ and $C_2$ (1:1) |
| 203 | (G) | E × Y | (F) | E × $M_2$ | (J) | E × $C_4$ |
| 204 | (G) | E × Y | (F) | E × $M_3$ | (J) | E × $C_4$ |
| 205 | (G) | E × Y | (F) | E × $M_4$ | (J) | E × $C_4$ |
| 206 | (G) | E × Y | (F) | E × $M_3$ | (J) | E × $C_3$ |
| 207 | (G) | E × Y | (F) | E × $M_3$ | (J) | E × $C_5$ |
| 208 | (G) | E × Y | (F) | E × $M_3$ | (J) | E × $C_1$ |

*Silver halide emulsion coverage of the third layer is controlled so as to be 0.18 g/m², when couplers used in the third layer are those other than E × $M_1$.

Layer Structure

The composition of each layer on Sample 201 is shown below. The numerals show coated amounts in g/m² but shown the coated amount (g/m²) as silver for silver halide emulsion layer.

In addition, the support was a paper support, both surfaces of which were coated with polyethylene wherein titanium dioxide as white pigment and blue dye (ultramarine) were contained in polyethylene having the first layer thereon. The hardening agent used in each layer was sodium 1-oxy-3,5-dichloro-s-triazine.

| | |
|---|---|
| Layer 1 (Blue-Sensitive Layer) | |
| Silver Halide Emulsion | 0.30 |
| Gelatin | 1.86 |
| Yellow Coupler (ExY) | 0.82 |
| Color Image Stabilizer (Cpd - 1) | 0.19 |
| Solvent (Solv - 1) | 0.35 |
| Layer 2 (Color mixing Preventing Layer) | |
| Gelatin | 0.99 |
| Color Mixing Preventor (Cpd - 2) | 0.08 |
| Layer 3 (Green-Sensitive Layer) | |
| Silver Chlorobromide Emulsion | 0.36 |
| Gelatin | 1.24 |
| Magenta Coupler (ExM - 1) | 0.31 |
| Color Image Stabilizer (Cpd - 3) | 0.25 |
| Color Image Stabilizer (Cpd - 4) | 0.12 |
| Solvent (Solv - 2) | 0.42 |
| Layer 4 (Ultraviolet Absorptive Layer) | |
| Gelatin | 1.58 |
| Ultraviolet Absorbent (UV - 1) | 0.62 |
| Color Mixing Preventor (Cpd - 5) | 0.05 |
| Solvent (Solv - 3) | 0.24 |
| Layer 5 (Red-Sensitive Layer) | |
| Silver Chlorobromide Emulsion | 0.23 |
| Cyan Couplers (blend of ExC - 1 and ExC - 2 at 1:1) | 0.34 |
| Color Image Stabilizer (Cpd - 6) | 0.17 |
| Polymer (Cpd - 7) | 0.40 |
| Solvent (Solv - 4) | 0.23 |
| Layer 6 (Ultraviolet Absorptive Layer) | |
| Gelatin | 0.53 |
| Ultraviolet Absorbent (UV - 1) | 0.21 |
| Solvent (Solv - 3) | 0.08 |
| Layer 7 (Protective Layer) | |
| Gelatin | 1.33 |
| Acryl-Modified Copolymer of Polyvinyl Alcohol (modified degree 17%) | 0.17 |
| Liquid Paraffin | 0.03 |

Each of the coated sample 201 to 208 thus prepared was exposed and processed as shown in processing 1 and then the sensitivities of each of blue sensitive layers, green-sensitive layers, and red-sensitive layers were compared. The results obtained are shown in Table 5.

TABLE 5

| Sample | Blue-sensitive Layer | Green-sensitive Layer | Red-sensitive Layer | Notes |
|---|---|---|---|---|
| 201 | 100 | 100 | 100 | Comparison |
| 202 | 415 | 401 | 370 | Present Invention |
| 203 | 410 | 411 | 411 | " |
| 204 | 409 | 405 | 410 | " |
| 205 | 411 | 410 | 410 | " |
| 206 | 409 | 404 | 330 | " |
| 207 | 414 | 406 | 411 | " |
| 208 | 415 | 405 | 371 | " |

As is clear from the results shown in Table 5 above, it can be seen that the coated samples of this invention have very high sensitivity as compared with the comparison sample.

The following processings (2) and (3) are applied in the same manner as Example 2, and the same results as in Table 5 were obtained to ascertain the effects of the present invention.

Processing (2)

| Processing Step | Temperature | Time |
|---|---|---|
| Color Development | 35° C. | 45 sec. |
| Blix | 30 to 35° C. | 45 sec. |
| Wash ① | 30 to 35° C. | 20 sec. |
| Wash ② | 30 to 35° C. | 20 sec. |
| Wash ③ | 30 to 35° C. | 20 sec. |
| Wash ④ | 30 to 35° C. | 30 sec. |
| Drying | 70 to 80° C. | 60 sec. |

Counter-current system using 3 tanks from wash step ④ to ① was applied.

The compositions of the processing solutions used were as follows.

| | |
|---|---|
| Color Developer | |
| Water | 800 ml |
| Ethylenediamine-N,N,N',N'-tetiamethylene phosphonic Acid | |
| Methyltriethylene diamine | 1.5 g |
| (1,4-diaza-bicyclo[2,2,2]octane) | 5.0 g |
| Sodium Chloride | 1.4 g |
| Potassium, Carbonate | 25.0 g |
| N-ethyl-N-(β-methanesulphoneamidoethyl)-3-methyl-4-aminoaniline sulfate | 5.0 g |
| N,N-diethylhydroxylamine | 5.0 g |
| Fluorescent Blightening Agent (UVITEX CK trade name, made by Ciba-Geigy Corporation) | 2.0 g |
| Water to make | 1,000 ml |
| pH (25° C.) | 10.10 |
| Blix | |
| Water | 400 ml |
| Ammonium Thiosulfate (70%) | 100 ml |
| Sodium Sulfite | 18 g |
| $NH_4$ [EDTA.Fe(III)] | 55 g |
| EDTA.2Na | 3 g |
| Ammonium Bromide | 40 g |
| Sodium Sulfite | 16.71 g |
| Glacial Acetic Acid | 8 g |
| Water to make | 1000 ml |
| pH (25° C.) | 5.5 |

Washing Liquid

Ion Exchange Water (Ca ion and Mg ion each is contained in an amount of less than 3 ppm or less).

Processing (3)

The same processing step, Blix and Washing Liquid as in Processing (2) were used.

| Color Developer | |
|---|---|
| Water | 800 ml |
| Ethylenediamine-N,N,N',N'-tetiamethylene phosphonic Acid | |
| Methyltriethylene diamine | 1.5 g |
| (1,4-diaza-bicyclo[2,2,2]octane) | 5.0 g |
| Sodium Chloride | 1.4 g |
| Potassium, Carbonate | 25.0 g |
| N-ethyl-N-(β-methanesulphoneamidoethyl)-3-methyl-4-aminoaniline sulfate | 5.0 g |
| N,N-dicarboxyhydrazine | 5.0 g |
| Fluorescent Blightening Agent (UVITEX CK trade name, made by Ciba-Geigy Corporation) | 2.0 g |
| Water to make | 1,000 ml |
| pH (25° C.) | 10.10 |

EXAMPLE 3

By following the same procedure except that the support, the disposition of layers, the coated amounts of each layer were different and each emulsion was gold and sulfur-sensitized, Samples 301 to 308 were prepared. The combinations are shown in Table 6 below.

Layer Structure

The composition of each layer in Sample 301 is shown below. The numerals show the coated amount g/m$^2$, which is, however, shown as silver for the silver halide emulsions.

Support

Polyethylene Terephthalate Film (thickness 180 μm, having a layer of gelatin containing titanium dioxide as white pigment so that the white light transmittance becomes 30% at the emulsion layer coated side).

| | |
|---|---|
| Layer 1 (Green-sensitive Layer) | |
| Silver Halide Emulsion | 0.82 |
| Gelatin | 2.80 |
| Magenta Coupler (ExM 1) | 0.69 |
| Color Image Stabilizer (Cpd - 3) | 0.56 |
| Color Image Stabilizer (Cpd - 4) | 0.27 |
| Solvent (Solv - 2) | 0.95 |
| Layer 2 (Ultraviolet Absorptive Layer) | |
| Gelation | 1.58 |
| Ultraviolet Absorbent (UV - 1) | 0.62 |
| Color Mixing Preventor (Cpd - 5) | 0.05 |
| Solvent (Solv - 3) | 0.24 |
| Layer 3 (Red-sensitive Layer) | |
| Silver Halide Emulsion | 0.54 |
| Gelatin | 1.98 |
| Cyan Coupler (1:1 blend of ExC - 1 and ExC - 2) | 0.69 |
| Color Image Stabilizer (Cpd - 6) | 0.36 |
| Polymer (Cpd - 7) | 0.84 |
| Solvent (Solv - 4) | 0.48 |
| Layer 4 (Color Mixing Preventing Layer) | |
| Gelation | 0.99 |
| Color Mixing Preventor (Cpd - 2) | 0.08 |
| Layer 5 (Blue-sensitive Layer) | |
| Silver Halide Emulsion | 0.52 |
| Gelatin | 3.66 |
| Yellow Coupler (ExY) | 1.66 |
| Color Image Stabilizer (Cpd - 1) | 0.38 |
| Solvent (Solv - 1) | 0.70 |
| Layer 6 (Ultraviolet Absorptive Layer) | |

-continued

| | |
|---|---|
| Gelatin | 0.53 |
| Ultraviolet Absorbent (UV - 1) | 0.21 |
| Solvent (Solv - 3) | 0.08 |
| Layer 7 (Protective Layer) | |
| Gelatin | 1.33 |
| Acryl-Modified Copolymer of Polyvinyl Alcohol (modified degree 17%) | 0.17 |
| Matting Agent (polymethyl methacrylate) | 0.04 |

The silver halide emulsions used in this example were prepared as follows. By following the same procedures as the cases of preparing Emulsions (H), (G), (A), (F), (I), and (J) in Example 2 except that each emulsion was subjected to optimum gold and sulfure sensitizations with chloroauric acid and sodium thiosulfate, Emulsions (L), (M), (N), (O), (P), and (Q) were obtained.

Using the combinations of these emulsions and the couplers as shown in Table 6 below, Samples 301 to 308 were also prepared by the same manner as above.

TABLE 6

| | First layer | | Third layer* | | Fifth layer | |
|---|---|---|---|---|---|---|
| Sample | Emulsion | Coupler | Emulsion | Coupler | Emulsion | Coupler |
| 301 | (N) | E × $M_1$ | (p) | Mixture of E × $C_1$ and $C_2$ (1:1 by weight) | (L) | E × Y |
| 302 | (O) | E × $M_1$ | (Q) | Mixture of E × $C_1$ and $C_2$ (1:1 by weight) | (M) | E × Y |
| 303 | (O) | E × $M_2$ | (Q) | E × $C_4$ | (M) | E × Y |
| 304 | (O) | E × $M_3$ | (Q) | B × $C_4$ | (M) | E × Y |
| 305 | (O) | E × $M_4$ | (Q) | E × $C_4$ | (M) | E × Y |
| 306 | (O) | E × $M_3$ | (Q) | E × $C_3$ | (M) | E × Y |
| 307 | (O) | E × $M_3$ | (Q) | E × $C_5$ | (M) | E × Y |
| 308 | (O) | E × $M_3$ | (Q) | E × $C_1$ | (M) | E × Y |

*Silver halide emulsion coverage of the third layer is controlled so as to be 0.29 g/m2, when couplers used in the first layer are those other than E × $M_1$.

Each of coated samples 301 to 308 thus obtained was exposed and subjected to Processing 2 shown below, and then the sensitivities of each of the green-sensitive layers, red-sensitive layers, and blue-sensitive layers were compared. The results obtained are shown in Table 7 below.

| | Processing A | |
|---|---|---|
| Processing Step | Temperature | Time |
| Color Development | 33° C. | 3 min. 30 sec. |
| Blix | 33° C. | 1 min. 30 sec. |
| Wash | 24 to 34° C. | 3 min. 30 sec. |

The compositions of the processing solutions used as follows.

| Color Developer | |
|---|---|
| Water | 800 ml |
| 1-Hydroxyethylidene-1,1-diphosphonic Acid (60%) | 2.0 g |
| Triethanolamine | 11 ml |
| Benzyl Alcohol | 15 ml |
| Diethylene Glycol | 0.2 ml |
| Potassium Sulfite | 1.8 g |
| Potassium Bromide | 0.6 g |
| Potassium Carbonate | 28 g |
| N-Ethyl-N-(β-methanesulfonamidoethyl)-3-methyl-4-aminoaniline Sulfate | 4.5 g |
| Hydroxylamine Sulfate | 3.0 g |

-continued

| | |
|---|---|
| Optical Whitening Agent (4,4'-diamino-stilbene series) | 0.5 g |
| Lithium Chloride | 2.0 g |
| Water to make | 1000 ml |
| pH (25° C.) | 10.10 |
| Blix Solution | |
| Water | 400 ml |
| Ammonium Thiosulfate (70% aq. soln) | 120 ml |
| Sodium sulfite | 18 g |
| Ethylenediaminetetracetic Acid Iron(III) Ammonium | 60 g |
| Ethylenediaminetetraacetic Acid Disodium | 5 g |
| Water to make | 1000 ml |
| pH (25° C.) | |

TABLE 7

| Sample | Green-sensitive Layer | Red-sensitive Layer | Blue-sensitive Layer | Remarks |
|---|---|---|---|---|
| 301 | 100 | 100 | 100 | Comparison |
| 302 | 398 | 355 | 400 | Present Invention |
| 303 | 395 | 391 | 391 | " |
| 304 | 385 | 385 | 390 | " |
| 305 | 389 | 390 | 390 | " |
| 306 | 389 | 305 | 385 | " |
| 307 | 396 | 386 | 381 | " |
| 308 | 380 | 355 | 392 | " |

As is clear from the results shown in Table 7 above, it can be seen that the samples of this invention having the combinations in this invention show very high speed or sensitivity as compared with the comparison sample using the comparison combination.

While the invention has been described in detail and with reference to specific embodiments thereof, it will be apparent to one skilled in the art that various changes and modification can be made therein without departing from the spirit and scope thereof.

What is claimed is:

1. A silver halide photographic material having at least one light-sensitive silver halide emulsion layer coated on a support, wherein said silver halide emulsion layer contains silver chlorobromide grains containing 90 mol % or more silver chloride, wherein the silver chlorobromide grains comprise cubic or tetradecahedral host silver halide grains with at least one surface region having a higher content of silver bromide at the surface, said host silver halide grains have a halogen composition of silver chlorobromide or silver chloride and said host grains have no silver iodide or less than 2 mol % of silver iodide, and said at least one surface region is located at the vicinity of at least one of the corners of the host grains, wherein the vicinity of the corners is the area within the area of a regular square having a side length of about one-third of the diameter of a circle having the same area as the projected area of a normal crystal silver chlorobromide grain, wherein (a) not more than 15 mol % of the average silver bromide content is present at the surface of said silver chlorobromide grains, and (b) the silver bromide content of the at least one surface region at the vicinity of the at least one of the corners of said silver chlorobromide grains is less than 60 mol %.

2. A silver halide photographic material as claimed in claim 1, wherein said silver chlorobromide grains are present in an amount of 70 mol % or more based on the total silver halide grains present in the same silver halide emulsion layer.

3. The silver halide photographic material as claimed in claim 1 or claim 2, wherein the silver bromide content of the region having a higher content of silver bromide is 60 mol % or less and the average content of silver bromide is 10 mol % or less.

4. A silver halide photographic material as claimed in claim 3, wherein said silver halide emulsion grains are prepared by ripening a mixture of host grains comprising silver chloride or silver chlorobromide containing 90 mol % or more of silver chloride and fine silver halide grains having finer grain sizes than that of the host grains and a higher silver bromide content than that of the host grains.

5. A silver halide photographic material as claimed in claim 4, wherein said ripening is carried out in the presence of a compound inhibiting or preventing halogen conversion and recrystalization.

6. A silver halide photographic material as claimed in claim 4, wherein the fine silver halide grains are silver bromide grains having a smaller average diameter than that of the host grains.

7. A silver halide photographic material as claimed in claim 5, wherein the fine silver halide grains contain (100) crystal planes and wherein at least one compound selected from the group consisting of cyanine dyes, merocyanine dyes, mercaptoazoles and nucleic acid decomposition products is adsorbed on (100) crystal planes of the silver halide grains in the silver halide emulsion.

8. A silver halide photographic material as claimed in claim 6, wherein the silver chlorobromide grains are prepared by supplying bromide ions through the host silver halide grains to precipitate a new silver halide phase which contains a high content of silver bromide at the surface of said host silver halide grains.

9. A silver halide photographic material as claimed in claim 7, wherein said cyanine dyes or merocyanine dyes are those represented by following formula (I), (II) or (III),

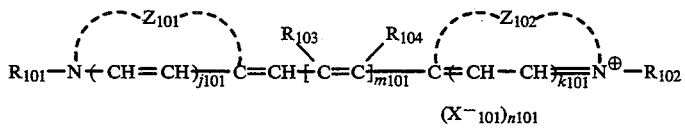

(I)

wherein $Z_{101}$ and $Z_{102}$ each represents an atomic group necessary for forming a heterocyclic nucleus, $R_{101}$ and $R_{102}$ each represents an alkyl group, an alkenyl group, an alkynyl group, or an aralkyl group, $m_{101}$ represents an integer of 1,2 or 3, $R_{103}$ represents a hydrogen atom, a lower alkyl group, an aralkyl group, or an aryl group and $R_{104}$ represents a hydrogen atom, when $m_{101}$ is 1, $R_{103}$ represents a hydrogen atom and $R_{104}$ represents a hydrogen atom, a lower alkyl group, or an aralkyl group or combine with $R_{102}$ to form a 5-membered or 6-membered ring, when $m_{101}$ is 2 or 3, $R_{103}$ may combine with another $R_{103}$ to form a hydrocarbon ring or a heterocyclic ring, $j_{101}$ and $k_{101}$ represent 0 or 1, $X_{101}$ represents an acid anion, and $n_{101}$ represents 0 or 1;

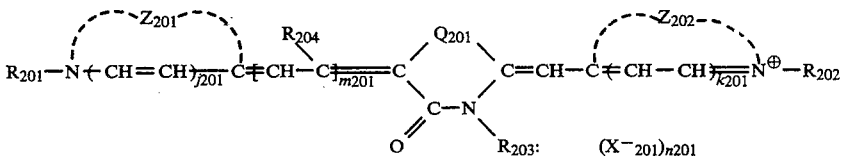

(II)

wherein $Z_{201}$ and $Z_{202}$ have the same significance as $Z_{101}$ or $Z_{102}$, $R_{201}$ and $R_{202}$ have the same significance as $R_{101}$ or $R_{102}$, $R_{302}$ represents an alkyl group, an alkenyl group, an alkynyl group, or an aryl group, $m_{201}$ represents 0, 1 or 2, $R_{204}$ represents a hydrogen atom, a lower alkyl group, or an aryl group, or $R_{204}$ and $R_{204}$ combine with each other to form a hydrocarbon ring or a heterocyclic ring when $m_{201}$ is 2, $Q_{201}$ represents a sulfur atom, an oxygen atom, a selenium atom or

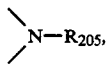

wherein $R_{205}$ has the same significance as $R_{203}$, and $j_{201}$, $X^-_{201}$, and $n_{201}$ have the same significance as $j_{101}$, $k_{101}$, $X^-_{201}$, and $n_{101}$, respectively, in formula (I);

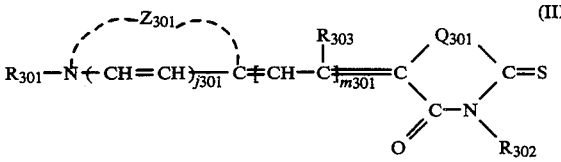

(III)

wherein $Z_{301}$ represents an atomic group necessary for forming a heterocyclic ring, $Q_{301}$ has the same significance as $Q_{201}$ in formula (II), $R_{301}$ has the same significance as $R_{101}$ or $R_{102}$ in formula (I), and $R_{302}$ has the same significance as $R_{203}$ in formula (II), $R_{303}$ has the same significance as $R_{204}$ in formula (II), or when $m_{301}$ is 2 or 3, $R_{303}$ may combine with another $R_{303}$ to form a hydrocarbon ring or a heterocyclic ring, $j_{301}$ has the same significance as $j_{101}$ in formula (I).

10. The silver halide photographic material as claimed in claim 1 or claim 2, wherein the support is a reflection support.

11. A silver halide photographic material as claimed in claim 4, wherein the amount of the fine silver halide grains is from 0.2 mol % to 20 mol % based on the amount of silver in all of the host grains.

12. A silver halide photographic material as claimed in claim 1, wherein the silver halide emulsion layer contains a color coupler.

13. A silver halide photographic material as claimed in claim 1 or 2, wherein said material comprises a blue-sensitive silver halide emulsion layer containing a yellow-coloring coupler, a green-sensitive silver halide emulsion layer containing a magenta-coloring coupler, and a red-sensitive silver halide emulsion layer containing a cyan-coloring coupler coated on said support in the order of the layers recited and the total coated amount of silver is not more than 3 g/m$^2$.

14. A silver halide photographic material as claimed in claim 3, wherein said material comprises a blue-sensitive silver halide emulsion layer containing a yellow-coloring coupler, a green-sensitive silver halide emulsion layer containing a magenta-coloring coupler, and a red-sensitive silver halide emulsion layer containing a cyan-coloring coupler coated on said support in the order of the layers recited and the total coated amount of silver is not more than 3 g/m$^2$.

15. A silver halide photographic material as claimed in claim 4, wherein said material comprises a blue-sensitive silver halide emulsion layer containing a yellow-coloring coupler, a green-sensitive silver halide emulsion layer containing a magenta-coloring coupler, and a red-sensitive silver halide emulsion layer containing a cyan-coloring coupler coated on said support in the order of the layers recited and the total coated amount of silver is not more than 3 g/m$^2$.

16. A silver halide photographic material as claimed in claim 5, wherein said material comprises a blue-sensitive silver halide emulsion layer containing a yellow-coloring coupler, a green-sensitive silver halide emulsion layer containing a magenta-coloring coupler, and a red-sensitive silver halide emulsion layer containing a cyan-coloring coupler coated on said support in the order of the layers recited and the total coated amount of silver is not more than 3 g/m$^2$.

* * * * *